US009517905B2

(12) United States Patent
Yoshimizu

(10) Patent No.: US 9,517,905 B2
(45) Date of Patent: Dec. 13, 2016

(54) SEPARATION CONVEYANCE DEVICE, IMAGE FORMING APPARATUS, METHOD FOR CONTROLLING SEPARATION CONVEYANCE DEVICE, AND COMPUTER-READABLE RECORDING MEDIUM

(71) Applicant: Eiki Yoshimizu, Kanagawa (JP)

(72) Inventor: Eiki Yoshimizu, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/733,629

(22) Filed: Jun. 8, 2015

(65) Prior Publication Data

US 2015/0360892 A1 Dec. 17, 2015

(30) Foreign Application Priority Data

Jun. 13, 2014 (JP) ..... 2014-122663

(51) Int. Cl.
*B65H 5/06* (2006.01)
*B65H 7/12* (2006.01)
*B65H 3/52* (2006.01)

(52) U.S. Cl.
CPC ..... *B65H 5/068* (2013.01); *B65H 3/523* (2013.01); *B65H 5/062* (2013.01); *B65H 7/12* (2013.01); *B65H 2403/21* (2013.01); *B65H 2403/42* (2013.01); *B65H 2403/723* (2013.01); *B65H 2511/524* (2013.01); *B65H 2513/53* (2013.01); *B65H 2515/32* (2013.01)

(58) Field of Classification Search
CPC ..... B65H 7/18; B65H 3/0684; B65H 5/068; B65H 1/04; B65H 3/0669; B65H 7/20;B65H 5/26; B65H 7/06; B65H 3/0676; B65H 5/06; B65H 7/12
See application file for complete search history.

(56) References Cited

U.S. PATENT DOCUMENTS

2006/0071416 A1* 4/2006 Mizuno ..... B65H 5/06 271/258.01
2013/0026699 A1* 1/2013 Maruta ..... G03G 15/6564 271/110

(Continued)

FOREIGN PATENT DOCUMENTS

JP 2011-084399 4/2011
JP 2011-093670 5/2011

*Primary Examiner* — David H Bollinger
(74) *Attorney, Agent, or Firm* — Harness, Dickey & Pierce, P.L.C.

(57) ABSTRACT

A separation conveyance device comprises: a separation unit that includes a first roller feeding a conveyance object, and a load unit applying a load to the fed conveyance object, and separates one conveyance object from conveyance objects; a second roller that conveys the fed conveyance object; a driving unit that causes a motor to rotate the first roller at a first linear speed and the second roller at a second linear speed higher than the first linear speed; a connection unit that cuts off the motor's power from the first roller when first load torque toward a rotation direction of the first roller is equal to or larger than a certain value; a detection unit that detects second load torque in the direction opposite to a rotation direction of the motor; and a determination unit that determines a separation state of the conveyance object based on the second load torque.

13 Claims, 19 Drawing Sheets

(56) References Cited

U.S. PATENT DOCUMENTS

| | | | | |
|---|---|---|---|---|
| 2015/0091238 | A1* | 4/2015 | Hatakeyama | B65H 7/06<br>271/3.16 |
| 2015/0274465 | A1* | 10/2015 | Takahashi | B65H 5/062<br>271/265.04 |
| 2015/0277394 | A1* | 10/2015 | Iesaki | B65H 7/20<br>271/265.01 |

* cited by examiner

SEPARATION CONVEYANCE DEVICE, IMAGE FORMING APPARATUS, METHOD FOR CONTROLLING SEPARATION CONVEYANCE DEVICE, AND COMPUTER-READABLE RECORDING MEDIUM

CROSS-REFERENCE TO RELATED APPLICATIONS

The present application claims priority to and incorporates by reference the entire contents of Japanese Patent Application No. 2014-122663 filed in Japan on Jun. 13, 2014.

BACKGROUND OF THE INVENTION

1. Field of the Invention

The present invention relates to a separation conveyance device, an image forming apparatus, a method for controlling the separation conveyance device, and a computer-readable recording medium.

2. Description of the Related Art

Image forming apparatuses such as printers and multi-function printers and image reading apparatuses such as scanners separate a sheet from stacked sheets and convey the separated sheet using feeding mechanisms or automatic document feeders (ADFs), for example. Sheet separation mechanisms used in such image forming apparatuses and image reading apparatuses are required to prevent the occurrences of non-feeding in which a sheet fails to be fed, overlapped feeding in which multiple sheets are fed while being overlapped, and delay of a sheet separation time, for example. The delay of a sheet separation time leads to a reduction of productivity of the apparatus, for example.

In recent years, detection of the leading edge of a sheet using an optical sensor and determination of a conveyance state of the sheet on the basis of the detection result have been generally performed. Japanese Laid-open Patent Publication No. 2011-084399 discloses a technique in which a passage time between the leading and the rear edges of a sheet is measured on the basis of a detection result by an optical sensor and an error in sheet separation is determined on the basis of the measurement result.

Another technique is known in which the thickness of a sheet is measured by an overlapped feeding detection sensor using ultrasonic waves and it is determined whether or not the conveyed sheet is in a tendency of overlapped feeding.

Conventionally, the leading edge detection for determination of a conveyance state has been performed using an optical sensor used for sheet registration. In an image forming apparatus, a process for image forming starts just after the sheet registration, for example. This process, thus, causes a problem in that even if an error in sheet separation is detected the sheet may be conveyed so as to be subjected to image forming while being in the error state. To solve such a problem, an optical sensor may be additionally provided for detecting the conveyance state ahead of the position where the sheet registration is performed in the manner as disclosed in Japanese Laid-open Patent Publication No. 2011-084399. This, however, increases the cost of the apparatus.

The technique employing the overlapped feeding detection sensor using ultrasonic waves has a problem in that it is difficult for the technique to be applied to a sheet with an unknown thickness because the determination is performed on the basis of the measurement result of the thickness of the sheet. In addition, the overlapped feeding detection sensor increases the cost of the apparatus.

In view of such problems, there is a need to enable the conveyance state of a separated and conveyed sheet to be detected using a simpler structure.

SUMMARY OF THE INVENTION

It is an object of the present invention to at least partially solve the problems in the conventional technology.

According to the present invention, there is provided a separation conveyance device comprising: a separation unit that includes a first roller feeding a conveyance object, and a load unit applying a load to the conveyance object fed by the first roller, and separates one conveyance object from a plurality of conveyance objects using the load; a second roller that conveys the conveyance object fed from the first roller; a motor having a rotation speed feedback controlled; a driving unit that causes power of the motor to rotate the first roller at a first linear speed and the second roller at a second linear speed higher than the first linear speed; a connection unit that cuts off the power of the motor from the first roller when first load torque toward a rotation direction of the first roller is equal to or larger than a certain value; a detection unit that detects second load torque in the direction opposite to a rotation direction of the motor; and a determination unit that determines a separation state of the conveyance object by the separation unit on the basis of the second load torque.

The present invention also provides an image forming apparatus comprising: the above-described separation conveyance device; and an image reading unit that reads an image of the conveyance object separated by the separation conveyance device and conveyed to the image reading unit.

The present invention also provides a method for controlling a separation conveyance device that includes a separation unit including a first roller feeding a conveyance object, and a load unit applying a load to the conveyance object fed by the first roller, and separating one conveyance object from a plurality of conveyance objects using the load, a second roller conveying the conveyance object fed from the first roller, a motor having a rotation speed feedback controlled, a driving unit causing power of the motor to rotate the first roller at a first linear speed and the second roller at a second linear speed higher than the first linear speed, and a connection unit cutting off the power of the motor from the first roller when first load torque toward a rotation direction of the first roller is equal to or larger than a certain value, the method comprising: detecting second load torque in the direction opposite to a rotation direction of the motor; and determining a separation state of the conveyance object by the separation unit on the basis of the second load torque.

The present invention also provides a non-transitory computer-readable recording medium that contains a control program that causes a computer included in a separation conveyance device including a separation unit including a first roller feeding a conveyance object, and a load unit applying a load to the conveyance object fed by the first roller, and separating one conveyance object from a plurality of conveyance objects using the load, a second roller conveying the conveyance object fed from the first roller, a motor having a rotation speed feedback controlled, a driving unit causing power of the motor to rotate the first roller at a first linear speed and the second roller at a second linear speed higher than the first linear speed, and a connection unit cutting off the power of the motor from the first roller when first load torque toward a rotation direction of the first roller is equal to or larger than a certain value, to execute: detecting second load torque in the direction opposite to a rotation direction of the motor; and determining a separation state of the conveyance object by the separation unit on the basis of the second load torque.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The following describes embodiments of a separation conveyance device, an image forming apparatus, a method for controlling the separation conveyance device, and a computer-readable recording medium containing a computer program for controlling the separation conveyance device in detail with reference to the accompanying drawings.

First Embodiment

Figure 1:
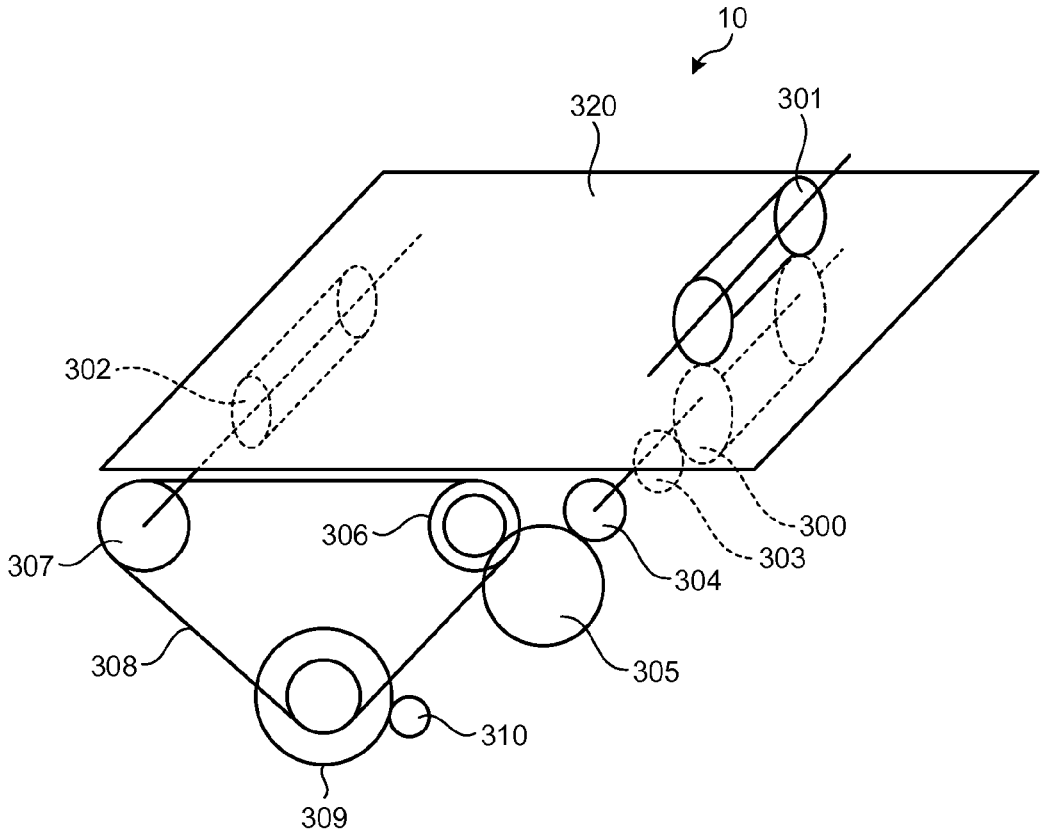
FIG. 1 is a schematic diagram schematically illustrating an exemplary structure of a separation conveyance device applicable to a first embodiment.

FIG. 1 is a schematic diagram schematically illustrating an exemplary structure of a separation conveyance device 10 applicable to a first embodiment. The structure illustrated in FIG. 1 is generally called a friction roller method, which is one of the separation conveyance methods. The separation conveyance device 10 feeds a sheet 320 serving as a conveyance object from a sheet bundle in which a plurality of sheets are stacked (not illustrated) and conveys the sheet 320. Here, the sheet is a sheet of paper. The sheet 320 is conveyed toward the left in FIG. 1.

As illustrated in FIG. 1, the separation conveyance device 10 includes a feed roller 300, a separation roller 301, and a conveyance roller 302, which are members directly in contact with the sheet 320. As illustrated in FIG. 1, the separation conveyance device 10 includes, as a structure of a driving transmission system that drives the feed roller 300 and the conveyance roller 302, a one-way clutch 303, a feed roller gear 304, an idler gear 305, a pulley with gear 306, a pulley 307, a timing belt 308, and a speed reduction gear 309.

The feed roller 300 and the separation roller 301 are closely arranged such that a distance between their surfaces corresponds to the estimated thickness of the sheet 320, for example. The feed roller 300 and the separation roller 301 form a separation unit. The separation roller 301 is configured to apply a force to the sheet 320 in a direction opposed to a rotation direction of the feed roller 300 when the sheet 320 is interposed between the feed roller 300 and the separation roller 301. In other words, the separation roller 301 is a load unit that applies a load to the sheet 320 serving as a conveyance object in the direction opposite to the conveyance direction of the sheet 320. The conveyance roller 302 is disposed at such a position that the distance from the feed roller 300 to the conveyance roller 302 is shorter than the estimated length of the sheet 320 in the conveyance direction.

The distance between the conveyance roller 302 and the feed roller 300 is the inter-axial distance between them.

In FIG. 1, the sheet 320 is picked up from a sheet bundle in which multiple sheets are stacked and fed toward the left in FIG. 1 by a pick-up roller (not illustrated) disposed on the right side of the feed roller 300. The sheet 320 then reaches the feed roller 300. In the picking and feeding, multiple sheets 320 are picked up simultaneously and fed due to friction forces between the sheets in some cases. One of the multiple sheets 320 having reached the feed roller 300 is separated by the separation roller 301 and fed from the feed roller 300. The sheet 320 fed from the feed roller 300 reaches the conveyance roller 302 without any change and is conveyed by the conveyance roller 302 toward the left in FIG. 1.

In a driving transmission system in FIG. 1, power of a motor gear shaft 310 of a motor (not illustrated) is transmitted to the speed reduction gear 309. The speed reduction gear 309 reduces a rotation speed of the motor gear shaft 310. The speed reduction gear 309 drives both of the pulley 307 and the pulley with gear 306 by a pulley coaxially provided to the speed reduction gear 309 via the timing belt 308. The pulley 307 drives the conveyance roller 302.

The pulley with gear 306 coaxially has the gear section and the pulley section. The gear section of the pulley with gear 306 drives the idler gear 305 using power that is transmitted from the timing belt 308 and received by the pulley section. The idler gear 305 drives the feed roller gear 304. The feed roller gear 304 drives the feed roller 300 through the one-way clutch 303. The power of the pulley with gear 306 is transmitted to the feed roller 300 at a certain rotation speed and in a certain rotation direction by the idler gear 305 and the feed roller gear 304.

In the structure illustrated in FIG. 1, the motor gear shaft 310 rotates to the right (clockwise), thereby driving the feed roller 300 and the conveyance roller 302 to rotate to the left (counterclockwise). As a result, the sheet 320 is conveyed toward the left in FIG. 1. The pulley with gear 306, the idler gear 305, and the feed roller gear 304 are designed such that a rotation speed $v_1$ of the feed roller 300 is lower than a rotation speed $v_2$ of the conveyance roller 302.

The one-way clutch 303 is provided coaxially with the feed roller 300 and the feed roller gear 304. The one-way clutch 303 controls a connection of power transmission from the feed roller gear 304 to the feed roller 300 in accordance with a load applied to the feed roller 300. More specifically, the one-way clutch 303 cuts off the power transmission from the feed roller gear 304 to the feed roller 300 when torque exceeding a predetermined value is applied to the feed roller 300 in the same direction as a direction driven by the feed roller gear 304. A one-way clutch using a twist coil spring can be used for the one-way clutch 303, for example.

As described above, the distance between the conveyance roller 302 and the feed roller 300 is shorter than the estimated length of the sheet 320 in the conveyance direction, and the conveyance roller 302 is driven to rotate at a higher speed than that of the feed roller 300. The one-way clutch 303 is used for causing the feed roller 300 to be rotated by being pulled by the sheet 320 when the sheet 320 reaches the conveyance roller 302 and is pulled by the rotation of the conveyance roller 302. This rotation state of the feed roller 300 is also described as a dragged rotation state.

The separation roller 301, which is configured to apply a force to the sheet 320 in the direction opposite to the conveyance direction, can apply a load to the sheet 320 in the direction opposite to the conveyance direction. The separation roller 301 may employ another structure that can apply a certain force to the sheet 320 in the direction opposite to the conveyance direction. The separation conveyance method is not limited to the friction roller method illustrated in FIG. 1. For example, a friction reverse roller method can be used as the separation conveyance method. A separation pad method can be used in which a force is applied to the sheet 320 conveyed to the feed roller 300 in the direction opposite to the conveyance direction using a separation pad that does not rotate but is fixed.

Figure 2:
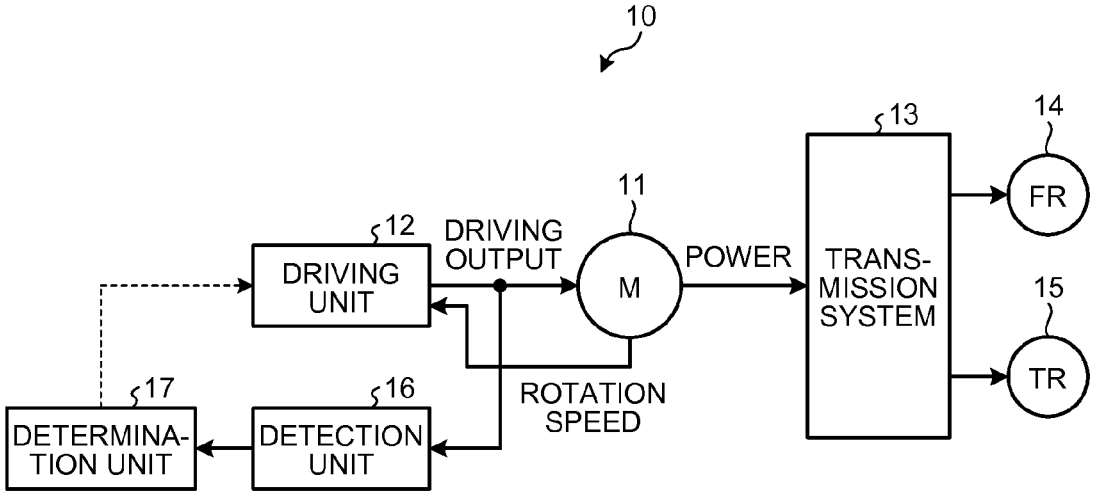
FIG. 2 is an exemplary functional block diagram to explain functions of a control system of the separation conveyance device according to the first embodiment.

FIG. 2 is an exemplary functional block diagram to explain functions of a control system of the separation conveyance device 10 according to the first embodiment. As illustrated in FIG. 2, the separation conveyance device 10 includes a motor 11, a driving unit 12, a transmission system 13, a feed roller (FR) 14, a conveyance roller (TR) 15, a detection unit 16, and a determination unit 17. The detection unit 16 and the determination unit 17 may be achieved by a program running on a central processing unit (CPU), or a part or all of them may be structured by pieces of hardware that cooperate with one another.

The feed roller 14 and the conveyance roller 15 correspond to the feed roller 300 and the conveyance roller 302 illustrated in FIG. 1, respectively. The transmission system 13 corresponds to the structure that includes the one-way clutch 303, the feed roller gear 304, the idler gear 305, the pulley with gear 306, the pulley 307, the timing belt 308, and the speed reduction gear 309. The motor (M) 11 is a direct current (DC) motor, for example. The motor gear shaft 310 is the rotation shaft of the motor 11.

The driving unit 12 produces a driving signal to drive the motor 11 and supplies the driving signal to the motor 11 as driving output. The driving signal is a pulse width modulation (PWM) signal, for example. The rotation torque of the motor 11 is controlled in accordance with a duty ratio of the PWM signal. The driving unit 12 supplies the produced driving signal to the motor 11 and the detection unit 16.

The motor 11 is provided with an encoder that outputs a pulse for each unit rotation angle. The rotation speed of the motor 11 can be known by counting the pulses included in the output of the encoder per unit time. Information that indicates the rotation speed of the motor 11 based on the output of the encoder is supplied to the driving unit 12. The driving unit 12 produces the driving signal so as to keep the rotation speed of the motor 11 constant on the basis of the supplied information about the rotation speed. In this way, the operation of the motor 11 is feedback-controlled.

The detection unit 16 detects whether or not a force (described as mechanical load torque) applied to the motor shaft of the motor 11 in the direction opposite to the rotation direction of the motor shaft exceeds a threshold on the basis of the driving signal supplied from the driving unit 12. The detection result is supplied to the determination unit 17. The determination unit 17 determines a separation state of the sheet 320 on the basis of the detection result by the detection unit 16. The determination unit 17 determines the separation state of the sheet 320 out of the following three types of states: a state where the sheet 320 is conveyed with a certain distance between sheets, a non-feeding state where the sheet fails to be conveyed, and an overlapped feeding state where multiple sheets are conveyed by being overlapped, for example.

The determination result by the determination unit 17 is supplied to the driving unit 12, for example. The driving unit 12 can produce the driving signal in accordance with the determination result by the determination unit 17. The determination unit 17 may also output the determination result outside the separation conveyance device 10.

A control program that achieves the detection unit 16 and the determination unit 17 is preliminarily stored in a read only memory (ROM). The control program according to the first embodiment is not limited to being stored in the ROM. The control program according to the first embodiment may be recorded and provided in a non-transitory computer-readable recording medium such as a compact disc (CD), a flexible disk (FD), and a digital versatile disc (DVD), as an installable or executable file.

The control program according to the first embodiment may be stored in a computer connected to a network such as the Internet and provided by being downloaded over the network. Furthermore, the control program according to the first embodiment may be provided or distributed via a network such as the Internet.

The control program according to the first embodiment has a module structure including the detection unit 16 and the determination unit 17. In practical hardware, the CPU (not illustrated) reads the control program from the ROM and executes the control program. The detection unit 16 and the determination unit 17 are loaded on a main storage (e.g., a random access memory (RAM)) and the detection unit 16 and the determination unit 17 are formed on the main storage.

Figure 3A:
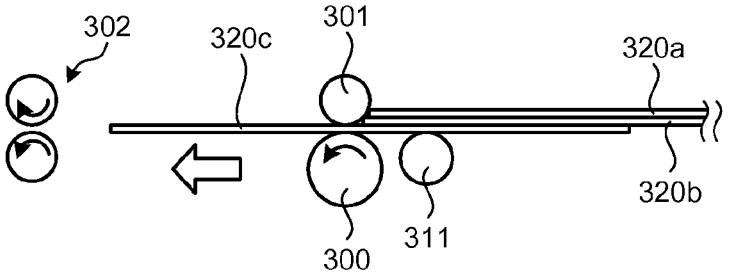
FIGS. 3A to 3D are schematic diagrams to explain a sheet separation conveyance operation.
Figure 3B:
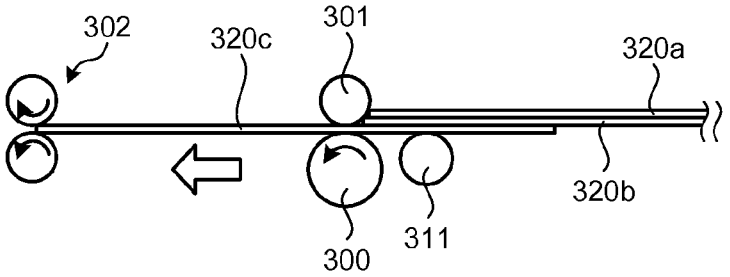
Figure 3C:
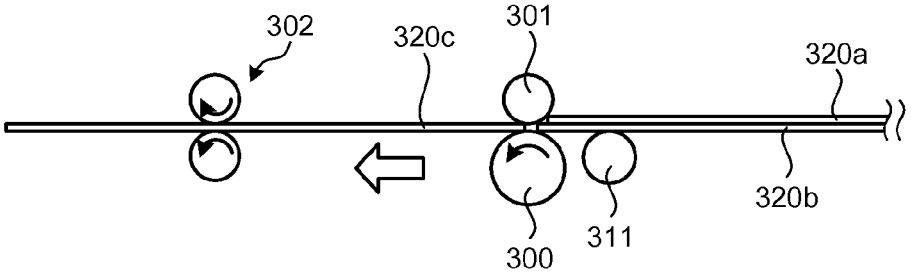

The following describes the separation conveyance operation with reference to FIGS. 3A to 3D. In FIGS. 3A to 3D, the same elements as FIG. 1 are labeled with the same numerals, and detailed descriptions thereof are omitted. In FIGS. 3A to 3D, the conveyance roller 302 is illustrated as a pair of rollers that sandwich the sheet 320. FIGS. 3A to 3C illustrate an example where a sheet 320*c* is separated from a sheet bundle including a sheet 320*a*, a sheet 320*b*, and the sheet 320*c* and is conveyed. In FIGS. 3A to 3C, the respective sheets 320*a*, 320*b*, and 320*c* are conveyed toward the left.

FIG. 3A illustrates a state where the sheet 320*c* undermost in the sheets 320*a* to 320*c* is picked up by a pick-up roller 311 and fed by the feed roller 300 toward the left in FIG. 3A. The state where the sheet 320*c* is fed by the feed roller 300 and then reaches the conveyance roller 302 is defined as a state A.

Power is transmitted to the pick-up roller 311 from a driving motor (not illustrated) that drives the pick-up roller 311 through a one-way clutch. The power from the driving motor to the pick-up roller 311 is cut off by the function of the one-way clutch when torque exceeding a predetermined value is applied in the same direction as the driving direction of the driving motor, which is the rotation direction of the pick-up roller 311.

With the movement of the sheet 320*c* picked up by the pick-up roller 311, the sheet 320*b* in contact with the sheet 320*c* moves toward the left. In the same manner, the sheet 320*a* in contact with the sheet 320*b* also moves toward the left. As a result, the sheets 320*a* to 320*c* enter a gap between the feed roller 300 and the separation roller 301.

The feed roller 300 included in the separation unit rotates counterclockwise in FIG. 3A following the conveyance direction. The separation roller 301 included in the separation unit applies a force in the direction opposite to the conveyance direction. As a result, a force in the conveyance direction (the left direction in FIG. 3A) is applied by the feed roller 300 to the sheet 320*c* undermost in the sheets 320*a* to 320*c*, which enter the gap between the feed roller 300 and the separation roller 301 while a force in the direction opposite to the conveyance direction is applied by the separation roller 301 to the sheet 320*a* uppermost in the sheets 320*a* to 320*c*.

The sheet 320*c* is conveyed by the feed roller 300 in the conveyance direction at a linear speed equal to or lower than a linear speed $v_1$. The sheet 320*c* is separated from the sheets 320*a* and 320*b* on the basis of a relation among a friction force acting between the separation roller 301 and the sheet 320*a*, a friction force acting between the sheets 320*a* and 320*b*, and a friction force acting between the sheets 320*b* and 320*c*, and singly fed from the feed roller 300. A conveyance speed of the sheet 320*c* does not exceed the linear speed $v_1$, which follows the rotation speed of the feed roller 300, because a slip occurs between the sheet 320*c* and the feed roller 300.

FIG. 3B illustrates a state where the sheet 320*c* fed by the feed roller 300 in the conveyance direction enters the conveyance roller 302. In the example illustrated in FIG. 3B, the conveyance roller 302 includes a pair of rollers rotating in the opposite direction from each other. The pair of rollers take in the entered sheet 320*c* and convey the sheet 320*c* at a linear speed $v_2$ higher than the linear speed $v_1$ toward the left in FIG. 3B. The state where the leading edge of the sheet 320*c* enters the conveyance roller 302 and where the rear edge of the sheet 320*c* fully leaves the feed roller 300 is defined as a state B.

A distance L between the conveyance roller 302 and the feed roller 300 is shorter than an estimated length P of the sheet 320*c* in the conveyance direction. Thus, the sheet 320*c* taken in the conveyance roller 302 is also in contact with the feed roller 300. The linear speed $v_2$ of the conveyance roller 302 is higher than the linear speed $v_1$ of the feed roller 300 as described above. The feed roller 300 is, thus, pulled by the sheet 320*c* and receives torque toward the conveyance direction. The torque causes the one-way clutch 303 (not illustrated in FIG. 3) to cut off power supplied to the feed roller 300. The feed roller 300 rotates in the dragged rotation state by the sheet 320*c*. The sheet 320*c* receives a force applied by the separation roller 301 in the direction opposite to the conveyance direction.

In the state B, the sheet 320*c* is still in contact with the pick-up roller 311. The pick-up roller 311 receives torque equal to or larger than a certain value in the same direction as the rotation direction thereof due to the sheet 320*c* pulled by the conveyance roller 302. The power applied to the pick-up roller 311 is, thus, cut off by the function of the one-way clutch 303. As a result, the pick-up roller 311 rotates in the dragged rotation state by the sheet 320*c*.

FIG. 3C illustrates a state where the rear edge of the sheet 320*c* fully leaves the separation unit including the feed roller 300 and the separation roller 301. The state where the rear edge of the sheet 320*c* fully leaves the separation unit is defined as a state C. In this state, the sheet 320*c* is conveyed by the conveyance roller 302 at the time when the sheet 320*c* fully leaves the feed roller 300 because the distance L is shorter than the length P. After the sheet 320*c* fully leaves the feed roller 300, the load applied to the feed roller 300 toward the conveyance direction is removed. The one-way clutch 303 connects the power transmission to the feed roller 300. As a result, the feed roller 300 rotates at the linear speed $v_1$.

When the sheet 320*c* fully leaves the pick-up roller 311 in a state just before the state illustrated in FIG. 3C, the torque applied to the pick-up roller 311 in the same direction as the rotation direction thereof is reduced to be equal to or smaller than a certain value. As a result, power is connected to the pick-up roller 311. The pick-up roller 311, thus, picks up the next sheet 320*b* so as to start the conveyance of the sheet 320*b*. From the start onwards, the separation conveyance processing is performed in the same manner as described above.

Figure 3D:
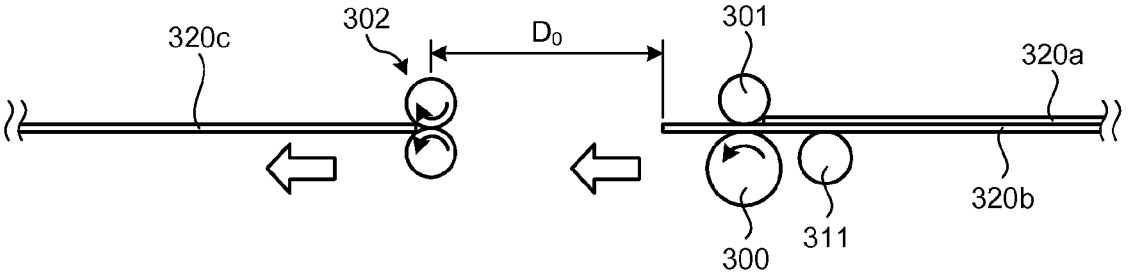

FIG. 3D illustrates a state where the sheet 320*c* fully leaves the conveyance roller 302 after the state illustrated in FIG. 3C. The distance between the sheet 320*c* and the next sheet 320*b* conveyed by the feed roller 300 is a certain distance $D_0$ corresponding to the ratio of the linear speed $v_2$ to the linear speed $v_1$, because the linear speed $v_2$ of the conveyance roller 302 is higher than the linear speed $v_1$ of the feed roller 300. When the respective sheets 320*a* to 320*c* are normally separated, the distance $D_0$ is a specified distance between the sheets, for example.

Figure 4:
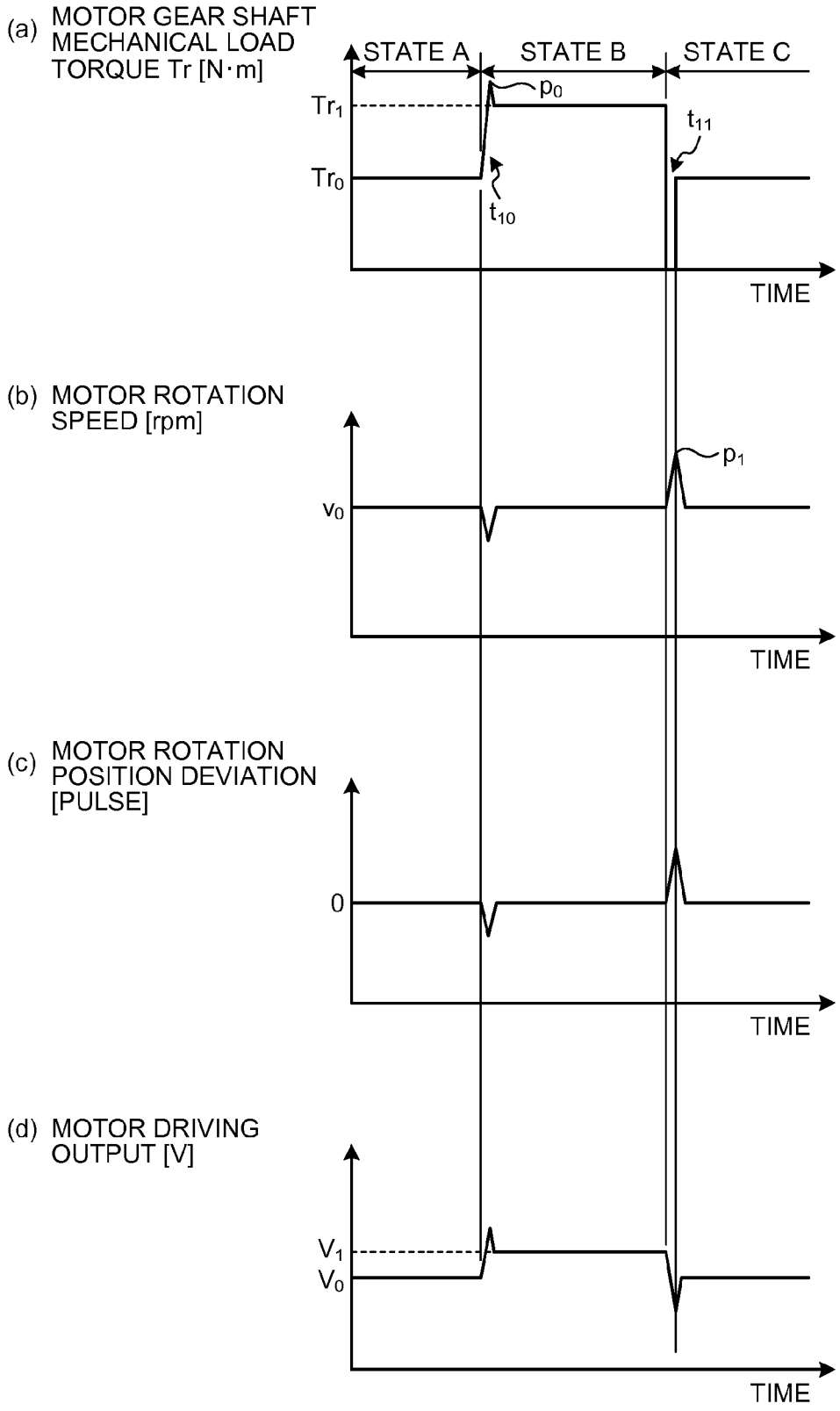
FIG. 4 is a schematic diagram to explain exemplary respective parameters of a motor in respective states in the sheet separation conveyance operation.

FIG. 4 exemplarily illustrates changes in respective parameters of the motor 11 in the states A, B, and C described above when the respective sheets 320*a* to 320*c* are normally separated, which is described as a normal separation. In FIG. 4, the abscissa axes each represent time while the ordinate axes represent values of the respective parameters. The following describes the respective states of the motor with reference to FIGS. 3A to 3C.

A section (a) of FIG. 4 illustrates an example of a temporal change in mechanical load torque (Nm) applied to the motor shaft of the motor 11. In the section (a), a torque value of the mechanical load torque in the state A, in which the sheet 320*c* is conveyed by the feed roller 300 and then reaches the conveyance roller 302, is a torque value $Tr_0$. In the state A, the mechanical load torque is the torque value $Tr_0$, which is a regular value corresponding to the separation conditions of the sheets 320*a* to 320*c*. The separation conditions include the number of set sheets, the types of sheets, the conditions of the separation roller 301 and the feed roller 300, and environmental conditions, for example.

In the transition from the state A to the state B, a peak $p_0$ appears (at a time $t_{10}$) in the mechanical load torque according to a response speed of the feedback control performed on the motor 11. In the transition from the state A to the state B, the mechanical load torque is fluctuated by the sheet 320*c* entering the conveyance roller 302 because the linear speed $v_2$ of the conveyance roller 302 is higher than the linear speed $v_1$ of the feed roller 300. The fluctuation amount of the mechanical load torque depends on the thickness of the sheet 320*c*. The larger the sheet thickness is, the larger the load fluctuation is.

When the sheet 320*c* enters the conveyance roller 302 and the conveyance roller 302 starts the conveyance, the mechanical load torque is shifted to a torque value $Tr_1$ that is larger than the torque value $Tr_0$. The mechanical load torque is stabilized at the torque value $Tr_1$. When the sheet 320*c* enters the conveyance roller 302, a transmission route of a force applied to the sheet 320*c* by the separation roller 301 in the direction opposite to the conveyance direction is changed because the linear speed $v_2$ of the conveyance roller 302 is higher than the linear speed $v_1$ of the feed roller 300, which will be described in detail later. The change in the transmission route causes a change in the mechanical load torque applied to the motor shaft of the motor 11.

Just after the rear edge of the sheet 320*c* leaves the separation unit in the transition from the state B to the state C, the connection of power to the feed roller 300 is delayed by a time of a transmission margin of the one-way clutch 303, thereby producing a time period during which the load applied to the feed roller 300 is not transmitted to the motor shaft (a time $t_{11}$). Thereafter, the power connection to the feed roller 300 is recovered by the one-way clutch 303. The mechanical load torque is then stabilized at the torque value $Tr_0$ of the state A.

The relation between the torque value $Tr_0$ in the state A or the state C and the torque value $Tr_1$ in the state B corresponds to the ratio of the linear speed $v_2$ of the conveyance roller 302 to the linear speed $v_1$ of the feed roller 300. The relation between the torque value $Tr_0$ and the torque value $Tr_1$, and the relation between the linear speed $v_2$ and the linear speed $v_1$ are represented by expression (1).

$$v_2/v_1 = Tr_1/Tr_0 \quad (1)$$

A section (b) of FIG. 4 illustrates an example of a temporal change in rotation speed (revolutions per minute (rpm)) of the motor 11. The rotation speed of the motor 11 is controlled to a constant speed $v_0$ by the driving unit 12 on the basis of the output of the encoder included in the motor 11. The rotation speed of the motor 11 is fluctuated in accordance with the fluctuation of the mechanical load torque in the transition from the state A to the state B and in the transition from the state B to the state C.

More specifically, a rotation speed v of the motor 11 is once lowered from the speed $v_0$ with an increase in the mechanical load torque in the transition from the state A to the state B, and after a response time of the feedback control elapses, the rotation speed v of the motor 11 is increased to the original speed $v_0$, with which the rotation speed v is stabilized. In the transition from the state B to the state C, in the same manner as described above, the rotation speed of the motor 11 is once increased to a peak $p_1$ with a decrease in the mechanical load torque, and after a response time of the feedback control elapses, the rotation speed of the motor 11 is decreased by the feedback control to the original speed $v_0$, with which the rotation speed v is stabilized.

A section (c) of FIG. 4 illustrates an example of a temporal change in rotation position deviation of the motor 11. The rotation position deviation of the motor 11 is a difference obtained by sequentially comparing the number of pulses of the output of the encoder included in the motor 11 for each unit time, for example. The rotation position deviation is zero when the rotation speed of the motor 11 is constant when position-tracking feedback control is performed. The rotation position deviation of the motor 11 has the same temporal change as the rotation speed illustrated in the section (b) of FIG. 4.

A section (d) of FIG. 4 illustrates an example of a temporal change in the output of a driving signal that drives the motor 11. In this example, the driving unit 12 drives the motor 11 on the basis of the PWM signal in which the duty ratio is controlled based on the output of the encoder included in the motor 11. The section (d) of FIG. 4, thus, illustrates a temporal change in voltage value V, which is obtained by integrating the PWM signal.

In the section (d) of FIG. 4, the driving signal output in the state A is a voltage $V_0$. In the state B, the rotation speed of the motor 11 needs to be kept constant (refer to the section (b) of FIG. 4) even though the mechanical load torque applied to the motor shaft is larger than that in the state A as illustrated in the section (a) of FIG. 4. The driving signal output is, thus, controlled to a voltage $V_1$, which is larger than the voltage $V_0$ by the feedback control performed by the driving unit 12 at the time $t_{10}$. In the transition from the state B to the state C, in the same manner as described above, the driving signal output is once lowered with a decrease in the mechanical load torque, and after a response time of the feedback control elapses, the driving signal output is increased to the original voltage $V_0$, at which the driving signal output is stabilized.

As can be understood by comparing the section (a) of FIG. 4 with the section (d) of FIG. 4, the change in the mechanical load torque of the motor 11 corresponds to the change in the voltage value obtained from the driving signal output from the driving unit 12.

Figure 5A:
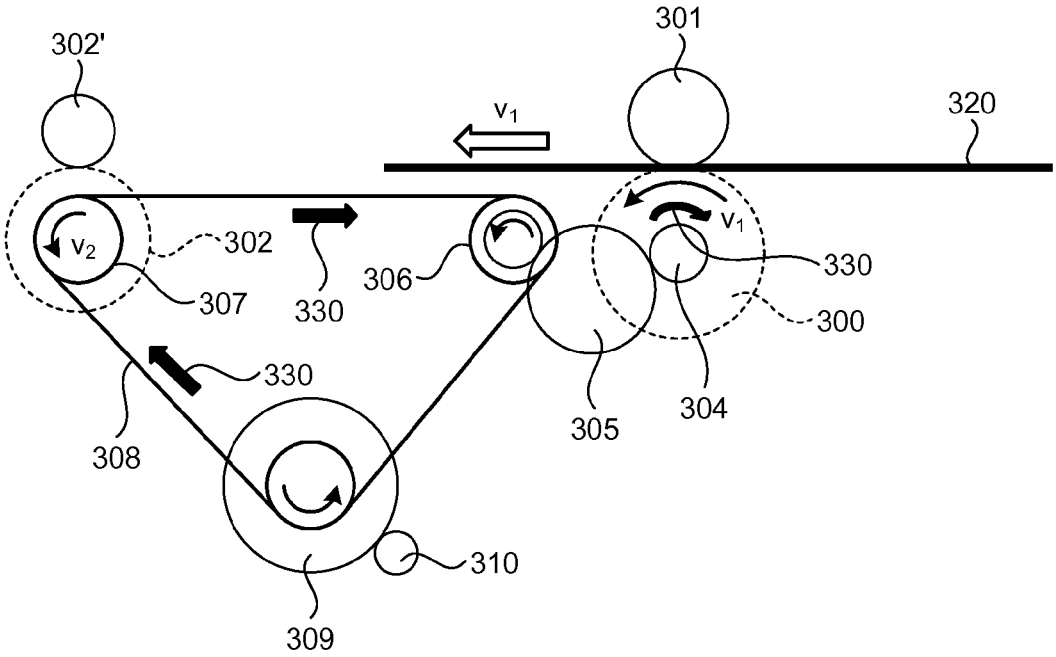
FIGS. 5A and 5B are schematic diagrams to explain a change of a force transmission route caused by a sheet entering a conveyance roller.
Figure 5B:
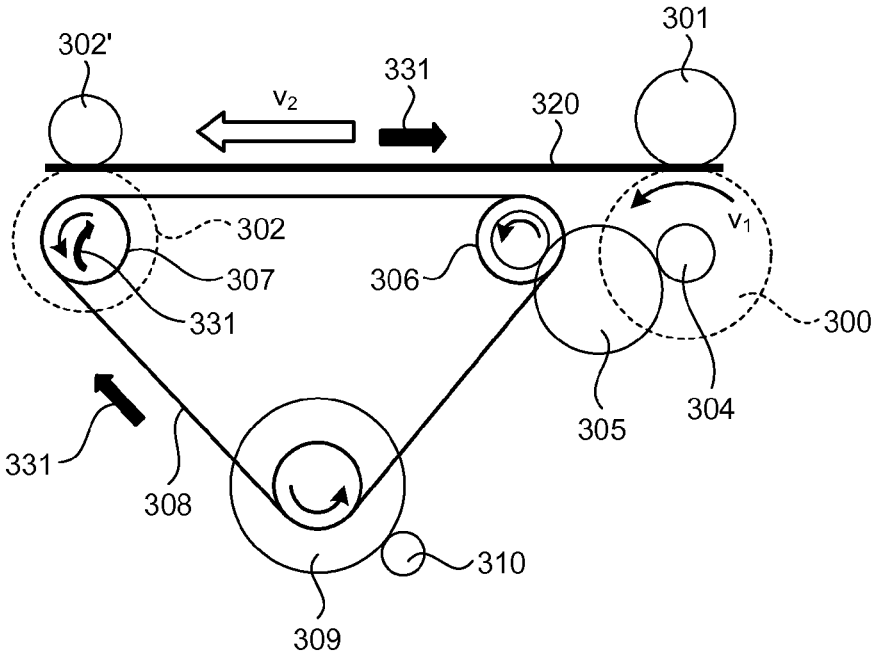

The following describes the change of the power transmission route caused by the sheet 320*c* entering the conveyance roller 302 with reference to FIGS. 5A and 5B. In FIGS. 5A and 5B, the same elements as FIG. 1 are labeled with the same numerals, and detailed descriptions thereof are omitted. In FIGS. 5A and 5B, the sheet 320 corresponds to the sheet 320*c*. The conveyance roller 302 includes a pair of the conveyance roller 302 and a conveyance roller 302'.

The unit that most contributes to the occurrence of the mechanical load torque applied to the motor shaft of the motor 11 in the sheet separation conveyance mechanism is the separation unit that includes the feed roller 300 and the separation roller 301. The mechanical load torque is particularly caused by a friction force that occurs between the separation roller 301 and the sheet 320 in the separation unit. The force applied by the separation roller 301 in the direction opposite to the conveyance direction of the sheet 320 is referred to as separation torque.

An upper limit value is set to the separation torque in the separation methods such as the friction roller (FR) method and the friction reverse roller (FRR) method. In the normal separation where the sheet is normally separated, the separation torque equal to or smaller than the upper limit value is applied to the separation roller 301. When the last sheet is conveyed, the sheet is conveyed while the separation roller 301 is rotated by the sheet. As a result, the separation torque larger than the upper limit value is applied to the separation roller 301. In the overlapped feeding where the multiple sheets are conveyed by being overlapped, the separation roller 301 is rotated by the sheets in the overlapped feeding state in some cases.

As illustrated with arrows 330 in FIG. 5A, until the sheet 320 enters the conveyance rollers 302 and 302', the separation torque is transmitted from the feed roller 300 that faces the separation roller 301 to the motor gear shaft 310 via the feed roller gear 304, the idler gear 305, the pulley section of the pulley with gear 306, the timing belt 308, the pulley 307, the timing belt 308, and the speed reduction gear 309 in this order. The separation torque transmitted to the motor gear shaft 310 is the mechanical load torque applied to the motor 11.

From when the leading edge of the sheet 320 enters the conveyance rollers 302 and 302' until the rear edge of the sheet 320 fully leaves the separation unit including the feed roller 300 and the separation roller 301, the sheet 320 is gripped by the pair of the conveyance rollers 302 and 302' and the pair of the feed roller 300 and the separation roller 301.

As described above, the linear speed $v_2$ of the conveyance roller 302 is higher than the linear speed $v_1$ of the feed roller 300. The power transmission from the motor 11 to the feed roller 300 is cut off by the one-way clutch 303 when the load toque equal to or larger than a certain value is applied to the feed roller 300. As a result, the feed roller 300 is rotated by being pulled by the sheet 320 conveyed by the conveyance roller 302 at the linear speed $v_2$, in the dragged rotation state. The separation torque of the separation roller 301 is, thus, transmitted to the motor gear shaft 310 by the sheet 320 that plays the same role as the timing belt 308 and the surface (outer diameter) of the conveyance roller 302 that plays the same role as the pulley 307.

More specifically, as illustrated with arrows 331 in FIG. 5B, the separation torque is transmitted from the sheet 320 to the motor gear shaft 310 via the conveyance roller 302, the pulley 307, the timing belt 308, and the speed reduction gear 309 in this order.

Before and after the sheet 320 enters the conveyance rollers 302 and 302', the separation torque is generated from the same source but the driving transmission system in which the separation torque is transmitted to the motor gear shaft 310 is switched. As a result, the mechanical load torque applied to the motor gear shaft 310 is changed. The magnitude of the change in the mechanical load torque is preliminarily determined by the difference between the linear speed $v_1$ of the feed roller 300 and the linear speed $v_2$ of the conveyance roller 302, and parameters of the mechanical driving system such as the diameters of the respective rollers. The magnitude of the change in the mechanical load torque is a fixed value.

As described above, the mechanical load torque is fluctuated before and after the sheet 320 enters the conveyance rollers 302 and 302'. The separation state of the sheet 320, thus, can be determined by detecting the fluctuation in output data of the motor 11 such as the rotation speed fluctuation, the rotation position deviation, and the driving signal change when the motor 11, which is a DC motor, is driven by the feedback control, as described above with reference to the section (b) to (d) of FIG. 4.

Separation States

The separation states of the sheet include the normal separation where the sheet is normally separated and conveyed with a certain distance between the sheets, the non-feeding state, the overlapped feeding state, a non-feeding tendency state, and an overlapped feeding tendency state. In the non-feeding state, the sheet fails to be fed. In the overlapped feeding state, the multiple sheets are fed by being overlapped. In the non-feeding tendency state, the sheet is separated but the distance between sheets is longer than a certain distance between sheets. In the overlapped feeding tendency state, the sheet is separated but the distance between sheets is shorter than a certain distance between the sheets. The overlapped feeding state can be classified into some patterns. The following roughly describes the separation states of the sheets with reference to FIGS. 6A to 10C. In FIGS. 6A to 10C, the same elements as FIG. 1 are labeled with the same numerals, and detailed descriptions thereof are omitted.

The overlapped feeding state is described below. The overlapped feeding state is generally classified into the following three patterns.

Figure 6A:
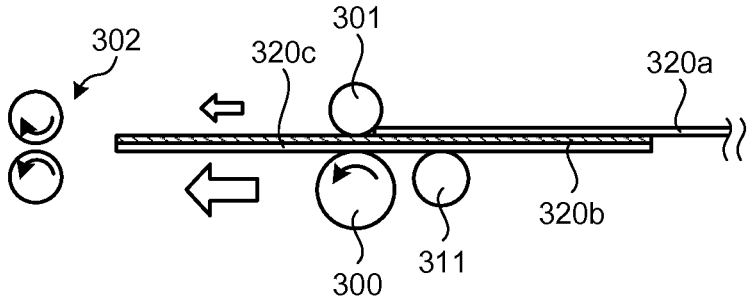
FIGS. 6A to 6C are schematic diagrams to explain a completely close contact pattern of an overlapped feeding state.
Figure 6B:
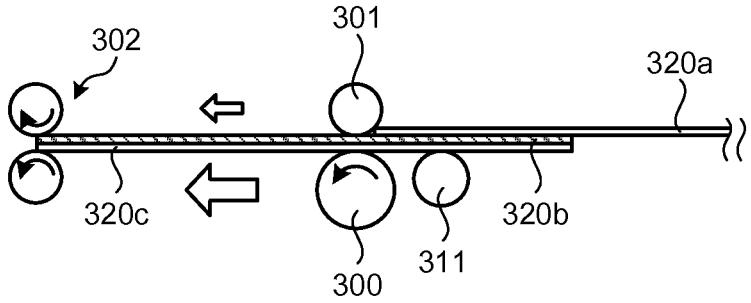
Figure 6C:
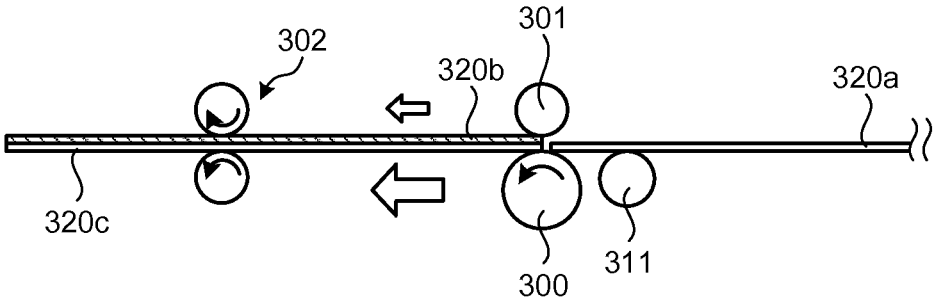

(1) Completely close contact pattern (2) Leading edge slippage pattern (3) Rush pattern The following describes the completely close contact pattern with reference to FIGS. 6A to 6C. In the completely close contact pattern of the overlapped feeding state, two sheets are not separated and conveyed while they are completely in close contact with each other. In the completely close contact pattern, the leading edges of the sheets 320*c* and 320*b* roughly coincide with each other and the sheets 320*c* and 320*b* are conveyed as if they are a single sheet. When the sheets 320*c* and 320*b* are regarded as a single sheet, the conveyance operation is almost the same as that of the normal separation described with reference to FIGS. 3A to 3D.

As illustrated in FIG. 6A, in the completely close contact pattern, the sheet 320*b* on the sheet 320*c* is conveyed together with the sheet 320*c* while their leading edges substantially coincide with each other when the pick-up roller 311 picks up the sheet 320*c* undermost in the sheets and conveys the sheet 320*c*. The sheet 320*b* is also conveyed while being in close contact with the sheet 320*c* when the sheet 320*c* is conveyed by the feed roller 300 at the linear speed $v_1$.

As illustrated in FIG. 6B, the sheets 320*c* and 320*b* enter the conveyance roller 302 while they are in close contact with each other and are conveyed by the conveyance roller 302 at the linear speed $v_2$. At the time, the rear edge side of the sheet 320*c* is still in contact with the feed roller 300. The feed roller 300 is, thus, pulled by the sheet 320*c* (and the sheet 320*b*), thereby receiving torque toward the conveyance direction. As a result, power transmission to the feed roller 300 is cut off by the one-way clutch 303. The feed roller 300 is, thus, rotated by the sheet 320*c* (and the sheet 320*b*) at the linear speed $v_2$, in the dragged rotation state.

As illustrated in FIG. 6C, when their rear edges fully leave the separation unit including the feed roller 300 and the separation roller 301, the sheets 320*c* and 320*b* are conveyed by the conveyance roller 302 at the linear speed $v_2$. When the sheets 320*c* and 320*b* fully leave the separation unit, the torque applied to the feed roller 300 toward the conveyance direction is removed. The one-way clutch 303 connects the power transmission to the feed roller 300. As a result, the feed roller 300 rotates at the linear speed $v_1$. The pick-up roller 311 picks up the sheet 320*a* following the sheet 320*b*. The sheet 320*a* enters the feed roller 300 and the conveyance at the linear speed $v_1$ starts.

Figure 7A:
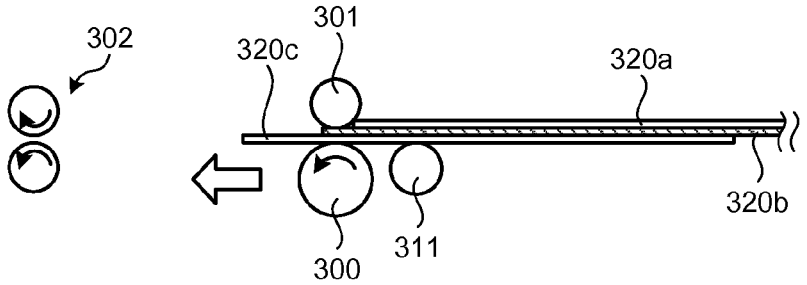
FIGS. 7A to 7C are schematic diagrams to explain a leading edge slippage pattern of the overlapped feeding state.
Figure 7B:
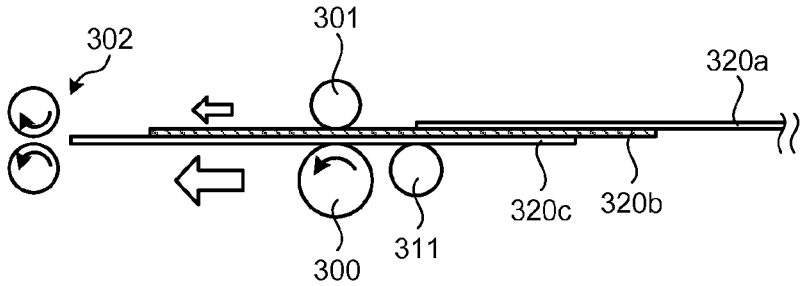
Figure 7C:
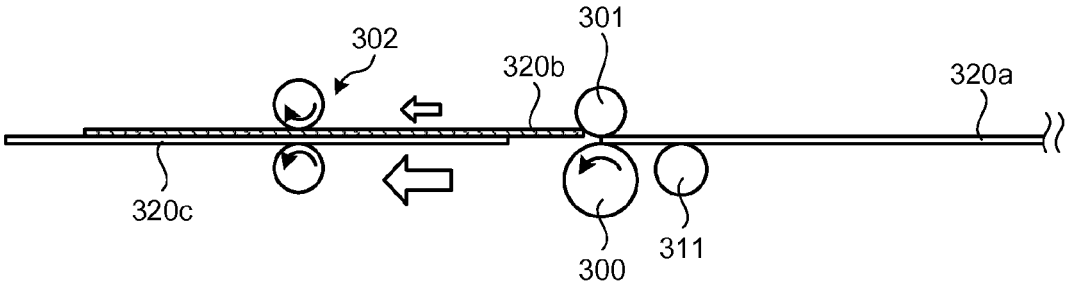

The following describes the leading edge slippage pattern with reference to FIGS. 7A to 7C. In the leading edge slippage pattern, the sheet 320*b* on the sheet 320*c* is conveyed together with the sheet 320*c* slightly after the conveyance of the sheet 320*c* when the sheet 320*c* in contact with the feed roller 300 is conveyed. In the leading edge slippage pattern, the sheet 320*b* is conveyed in such a manner that the leading edge of the sheet 320*b* is slightly behind the leading edge of the sheet 320*c* conveyed ahead.

As illustrated in FIG. 7A, in the leading edge slippage pattern, the sheet 320*c* undermost in the sheets 320*a* to 320*c* is picked up by the pick-up roller 311 and conveyed toward the left in FIG. 7A by the feed roller 300. The separation roller 301 applies a force to the sheet 320*a* uppermost in the sheets in the direction opposite to the conveyance direction.

It is assumed that a friction force between the sheets 320*a* and 320*b* becomes smaller than a friction force between the sheets 320*b* and 320*c* for some reason, for example. In this case, as illustrated in FIG. 7B, the sheet 320*b* is conveyed together with the sheet 320*c* with the conveyance of the sheet 320*c* in the overlapped feeding state where the sheet 320*b* partially overlaps with the sheet 320*c* in such a manner that the leading edge of the sheet 320*b* slips from the leading edge of the sheet 320*c*.

In the sheets 320*c* and 320*b* conveyed in the overlapped feeding state, the leading edge of the sheet 320*c* first enters the conveyance roller 302. This entering causes the one-way clutch 303 (not illustrated) to cut off the power transmission to the feed roller 300 by its function, and the transmission route of the separation torque by the separation roller 301 to be switched to one via the sheet 320*c* as described with reference to FIG. 5B. In this state, if a friction force between the separation roller 301 and the sheet 320*b* is smaller than a friction force between the sheets 320*b* and 320*c*, for example, the sheet 320*b* is conveyed together with the sheet 320*c*. When the leading edge of the sheet 320*b* enters the conveyance roller 302, the conveyance roller 302 conveys both of the sheets 320*b* and 320*c* together with each other.

The sheet 320*b* is pulled by the sheet 320*c* after the rear edge of the sheet 320*c* fully leaves the feed roller 300 and is conveyed together with the sheet 320*c*. The separation torque by the separation roller 301 is, thus, transmitted to the motor gear shaft 310 via the transmission route including the sheet 320*b* from when the sheet 320*c* fully leaves the feed roller 300 until the sheet 320*b* fully leaves the feed roller 300 (refer to FIG. 7C). The transmission route of the separation torque is switched to the transmission route via the timing belt 308, which is described with reference to FIG. 5A, when the sheet 320*b* fully leaves the feed roller 300.

Figure 8A:
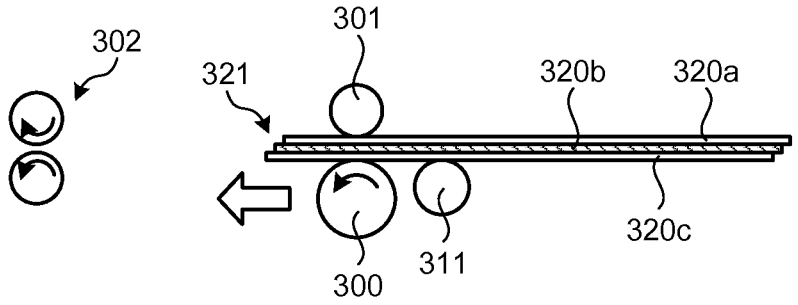
FIGS. 8A to 8C are schematic diagrams to explain a rush pattern of the overlapped feeding state.
Figure 8B:
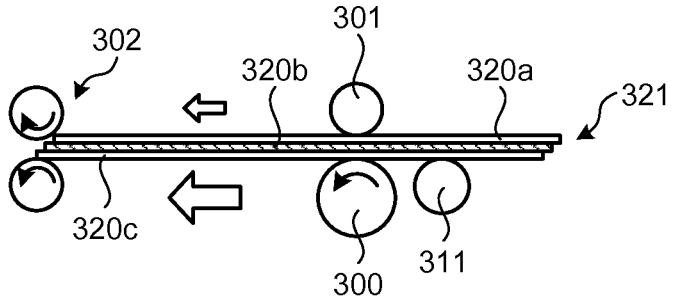
Figure 8C:
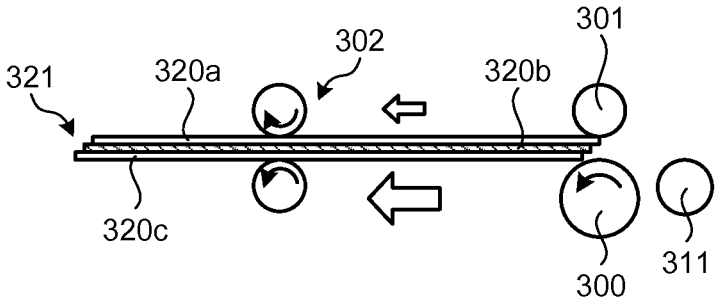

The following describes the rush pattern with reference to FIGS. 8A to 8C. In the rush pattern, multiple sheets of more than two sheets or all of the set sheets are conveyed simultaneously. As illustrated in FIG. 8A, in the rush pattern, the sheets 320*b* and 320*a* set on the sheet 320*c* by being overlapped in this order are conveyed together with the sheet 320*c* when the sheet 320*c* in contact with the feed roller 300 is conveyed. A sheet bundle 321 of the sheets 320*c*, 320*b*, and 320*a* is conveyed by the feed roller 300 at the linear speed $v_1$ and enters the conveyance roller 302 (refer to FIG. 8B).

The sheet bundle 321 having entered the conveyance roller 302 is conveyed by the conveyance roller 302 at the linear speed $v_2$. As a result, the sheet bundle 321 applies torque to the feed roller 300 toward the conveyance direction, thereby causing the one-way clutch 303 to cut off power transmission by its function. The feed roller 300, thus, rotates in the dragged rotation by the sheet bundle 321. The sheet bundle 321 is conveyed by the conveyance roller 302 as a whole, for example. Then, the rear edge of the sheet bundle 321 fully leaves the feed roller 300 (refer to FIG. 8C).

Figure 9A:
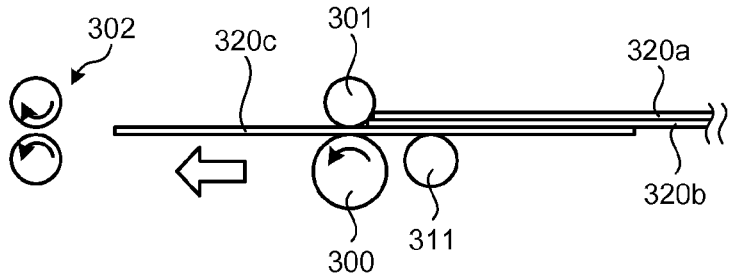
FIGS. 9A to 9D are schematic diagrams to explain an overlapped feeding tendency state.
Figure 9B:
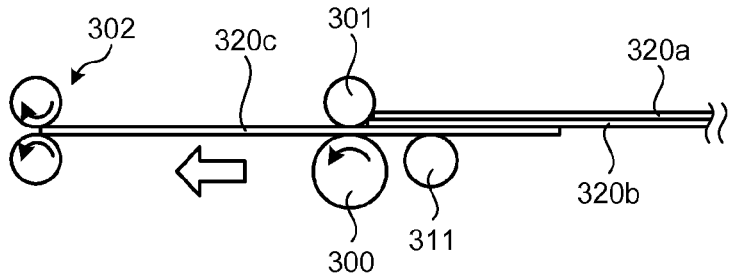
Figure 9C:
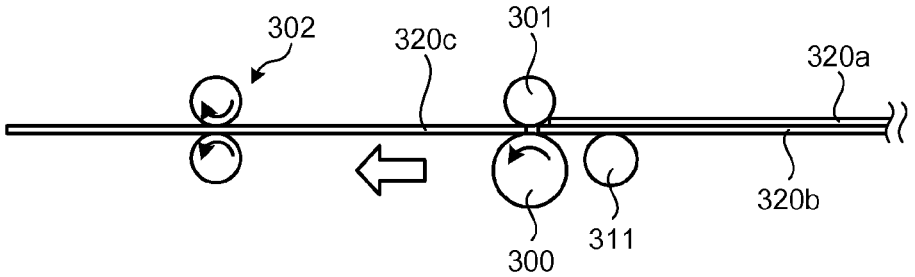

The following describes the overlapped feeding tendency state with reference to FIGS. 9A to 9D. The operation in the overlapped feeding tendency state is almost the same as that in the normal separation described with reference FIGS. 3A to 3D. As illustrated in FIG. 9A, the sheet 320*c* undermost in the sheets is picked up by the pick-up roller 311 and conveyed by the feed roller 300 at the linear speed $v_1$. As illustrated in FIG. 9B, the sheet 320*c* enters the conveyance roller 302 and is conveyed by the conveyance roller 302 at the linear speed $v_2$. The feed roller 300 rotates in the dragged rotation state by the sheet 320*c* conveyed at the linear speed $v_2$. As illustrated in FIG. 9C, the sheet 320*c* is conveyed by the conveyance roller 302. Then, the rear edge of the sheet 320*c* fully leaves the separation unit.

Figure 9D:
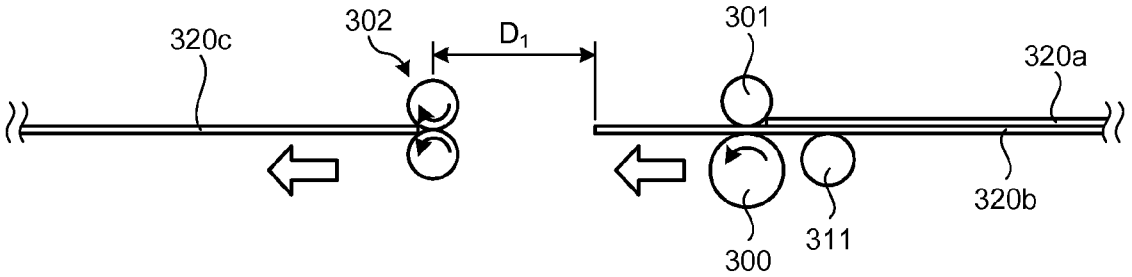

FIG. 9D illustrates a state where the sheet 320*c* fully leaves the conveyance roller 302 after the state illustrated in FIG. 9C. If the separation is performed normally, the distance between the rear edge of the sheet 320*c* and the leading edge of the sheet 320*b* is the specified distance $D_0$ as described with reference to FIG. 3D. If the separation state is the overlapped feeding tendency state, the distance between the rear edge of the sheet 320*c* and the leading edge of the sheet 320*b* following the sheet 320*c* is a distance $D_1$ that is shorter than the specified distance $D_0$ as illustrated in FIG. 9D.

When the distance is shorter than the specified distance while the sheets 320*c* and 320*b* do not overlap with each other, a system breakdown may occur in the case where the conveyance is continued. One of the causes that reduce a distance $D_1$ between the sheets 320*c* and 320*b* shorter than the specified distance $D_0$ may be wear of the separation roller 301 and the conveyance roller 302, for example. If this condition is left without any actions, the condition may worsen, thereby causing the separation state to be always in the overlapped feeding state.

Figure 10A:
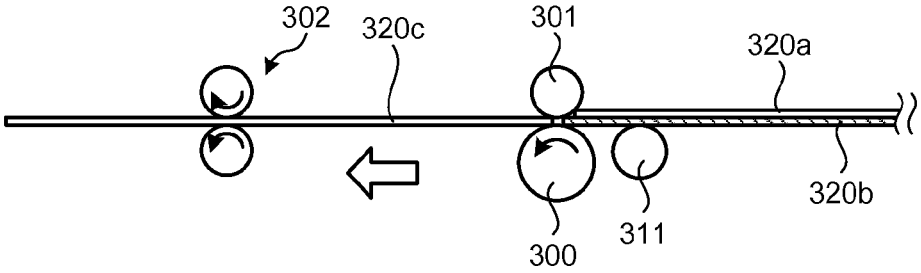
FIGS. 10A to 10C are schematic diagrams to explain a non-feeding state.
Figure 10B:
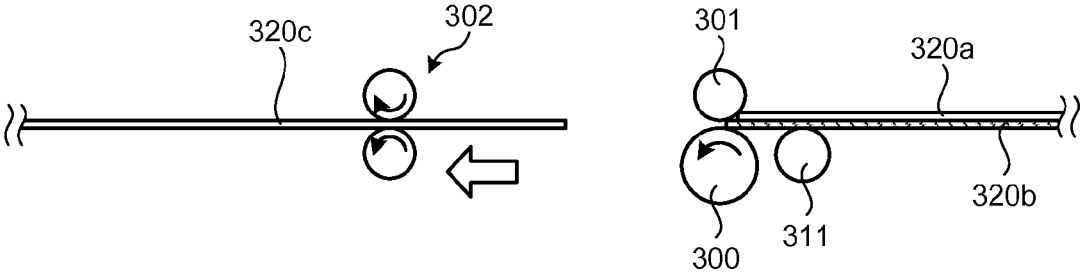
Figure 10C:
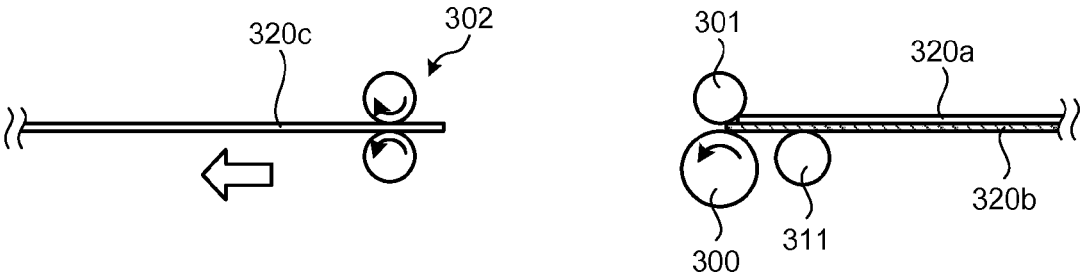

The following describes the non-feeding state with reference to FIGS. 10A to 10C. In the non-feeding state, the sheet 320*c* undermost in the sheets 320*a* to 320*c* is conveyed in the same manner as described with reference to FIGS. 3A to 3C and fully leaves the feed roller 300 (refer to FIG. 10A). In the non-feeding state, the sheet 320*b*, which should be conveyed following the sheet 320*c*, fails to be conveyed even after the sheet 320*c* fully leaves the feed roller 300 and remains at the feed roller 300 as illustrated in FIGS. 10B and 10C.

In the non-feeding tendency state, the sheet 320*b* following the sheet 320*c* is conveyed after the sheet 320*c* fully leaves the separation unit but the distance between the rear edge of the sheet 320*c* and the leading edge of the sheet 320*b* is longer than the specified distance $D_0$. This case may also cause the system breakdown when the conveyance is continued. One of the causes that increase the distance between the sheets 320*c* and 320*b* longer than the specified distance $D_0$ may be wear of the feed roller 300, for example. If this condition is left without any actions, the condition may worsen, thereby causing the separation state to be always in the non-feeding state.

Figure 11:
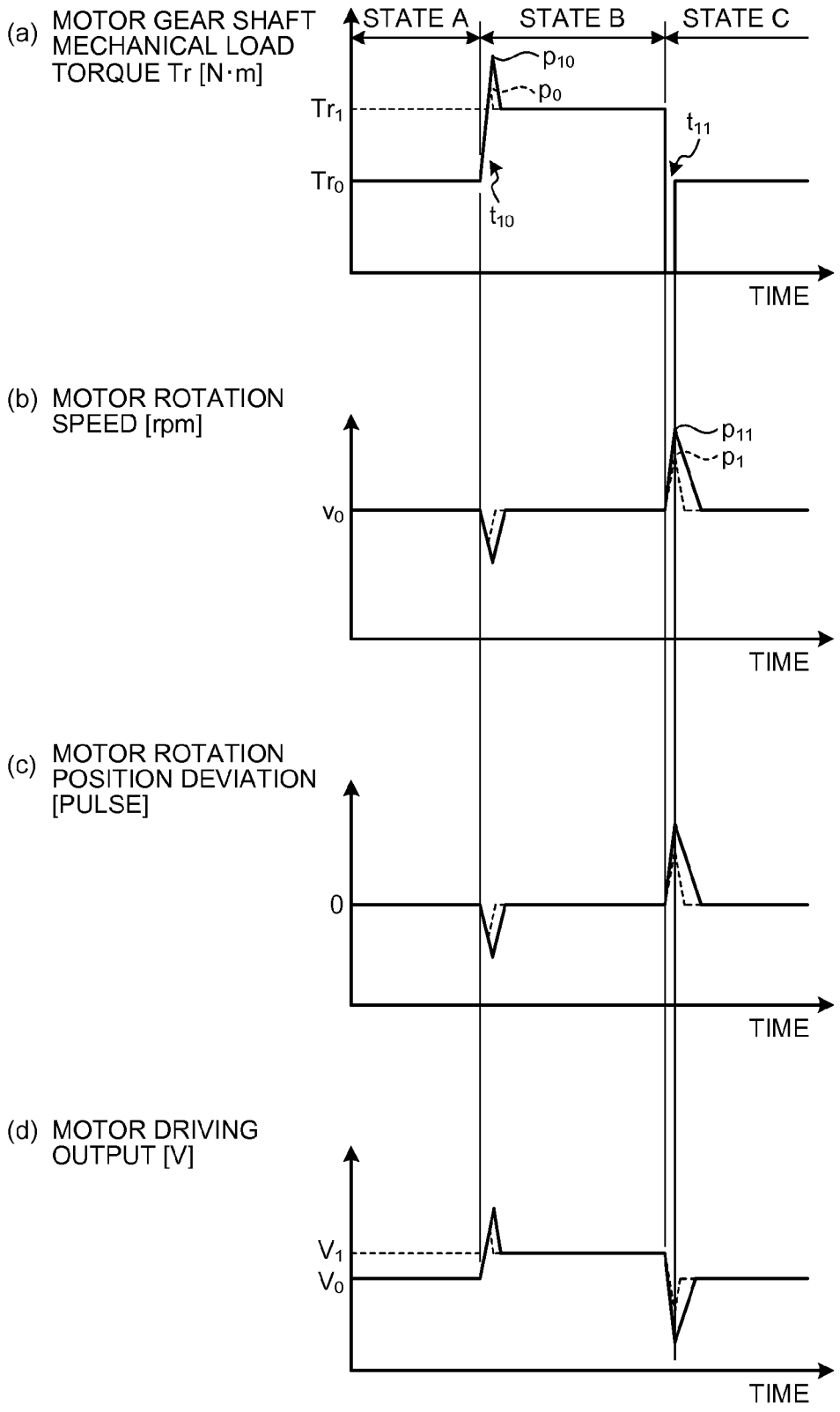
FIG. 11 is a schematic diagram illustrating exemplary changes in respective parameters of the motor in the completely close contact pattern.
Figure 12:
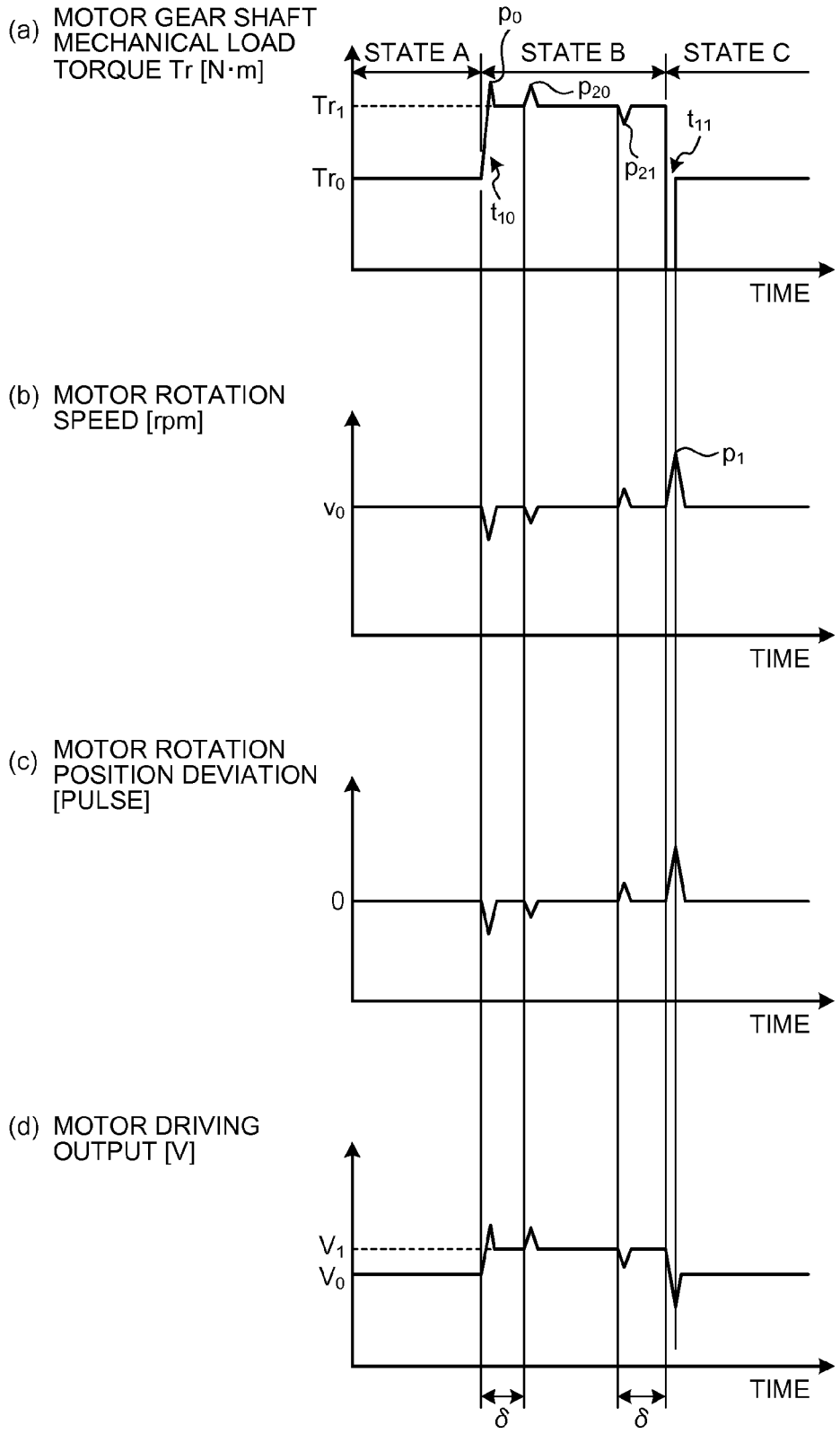
FIG. 12 is a schematic diagram illustrating exemplary changes in the respective parameters of the motor in the leading edge slippage pattern.
Figure 13:
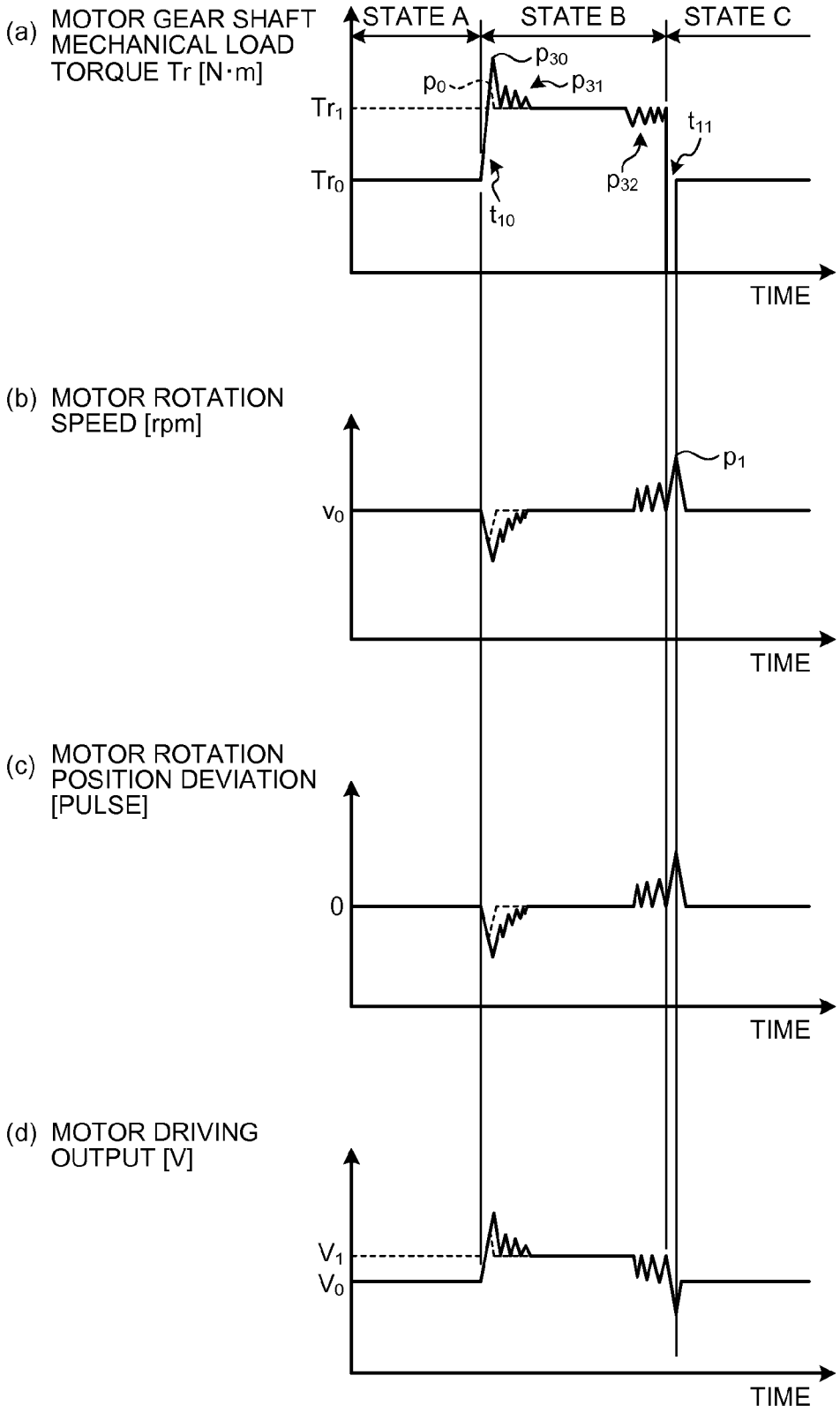
FIG. 13 is a schematic diagram illustrating exemplary changes in the respective parameters of the motor in the rush pattern.

The following describes changes in the respective parameters of the motor 11 in the completely close contact pattern, the leading edge slippage pattern, and the rush pattern with reference to FIGS. 11 to 13. In FIGS. 11 to 13, which correspond to FIG. 4, the abscissa axes each represent time while the ordinate axes represent values of the respective parameters.

FIG. 11 illustrates exemplary changes in the respective parameters of the motor 11 in the completely close contact pattern. In the completely close contact pattern, the sheets 320*c* and 320*b* are conveyed by being overlapped with each other. The total thickness of the sheets conveyed by being overlapped with each other is larger than the thickness of the sheet 320*c* conveyed singly. In the transition from the state A to the state B, i.e., when the sheets 320*c* and 320*b* enter the conveyance roller 302, an additional change appears with respect to the case where only the sheet 320*c* enters the conveyance roller 302.

As illustrated in a section (a) of FIG. 11, the peak of the mechanical load torque applied to the motor shaft of the motor 11 in the transition from the state A to the state B (time $t_{10}$) is a peak $p_{10}$ larger than the peak $p_0$ corresponding to the normal separation illustrated in the section (a) of FIG. 4, for example. Likewise, the respective peaks at the time $t_0$ of the motor rotation speed, the motor rotation position deviation, and the motor driving output illustrated in sections (b) to (d) of FIG. 11, respectively, are larger than those in the normal separation illustrated in the sections (b) to (d) of FIG. 4.

In the transition from the state B to the state C (time $t_{11}$), the peak of the motor rotation speed is a peak $p_{11}$ illustrated in the section (b) of FIG. 11, for example. The peak $p_{11}$ is larger than the peak $p_1$ in the normal separation.

FIG. 12 illustrates exemplary changes in the respective parameters of the motor 11 in the leading edge slippage pattern. In the leading edge slippage pattern, the sheet 320*b* following the sheet 320*c* enters the conveyance roller 302 while the sheet 320*c* having entered the conveyance roller 302 ahead has not yet fully left the separation unit. In the leading edge slippage pattern, the sheet 320*b* enters the conveyance roller 302 while the sheet 320*c* is just passing through the conveyance roller 302. When the sheet 320*b* enters the conveyance roller 302, the thickness of the sheet passing through the conveyance roller 302 is twice as much. As a result, in the state B, peaks occur in the respective parameters corresponding to the time when the sheet 320*b* enters the conveyance roller 302.

As illustrated in a section (a) of FIG. 12, the mechanical load torque applied to the motor shaft of the motor 11 has a peak $p_0$ due to the entering of the sheet 320*c* in the transition from the state A to the state B, for example. The mechanical load torque has a peak $p_{20}$ due to the entering of the sheet 320*b* in the state B, i.e., in a time period from the time $t_{10}$ to the time $t_{11}$. The mechanical load torque has a valley, i.e., a peak $p_{21}$ on a negative side when the sheet 320*c* fully leaves the separation unit in the state B.

Likewise, two peaks in the transition from the state A to the state B and in the state B also occur in the motor rotation speed, the motor rotation position deviation, and the motor driving output illustrated in sections (b) to (d) of FIG. 12, respectively.

The time period from the occurrence of the peak $p_0$ due to the sheet 320*c* to the occurrence of the peak $p_{20}$ due to the sheet 320*b* corresponds to a slip amount $\delta$ between the leading edge of the sheet 320*c* and the leading edge of the sheet 320*b*.

FIG. 13 illustrates exemplary changes in the respective parameters of the motor 11 in the rush pattern. In the rush pattern, a sheet group including a lot of sheets is conveyed simultaneously or the sheets included in the sheet group are continuously conveyed with short intervals, in the friction roller sheet separation method and the friction reverse roller sheet separation method. In the rush pattern, the respective parameters each have a large peak at the time when the leading edge of the sheet group enters the conveyance roller 302 and a plurality of small peaks at the times when the other sheets in the sheet group enter the conveyance roller 302.

As illustrated in a section (a) of FIG. 13, the mechanical load torque applied to the motor shaft of the motor 11 has a peak $p_{30}$ larger than the peak $p_0$ in the normal separation at the time when the leading edge of the sheet group enters the conveyance roller 302 in the transition from the state A to the state B, for example. The mechanical load torque has a peak group $p_{31}$ including a plurality of peaks after the peak $p_{30}$.

Just before the transition from the state B to the state C, a peak group $p_{32}$ including a plurality of peaks occurs corresponding to the times when the respective sheets included in the sheet group fully leave the conveyance roller 302. The peak group $p_{32}$ occurring just before the transition from the state B to the state C is on the negative side, whereas the peak group $p_{31}$ is on the positive side, because the respective sheets fully leave the separation unit.

Likewise, the multiple peaks in the transition from the state A to the state B and just before the transition from the state B to the state C also occur in the motor rotation speed, the motor rotation position deviation, and the motor driving output illustrated in sections (b) to (d) of FIG. 13, respectively.

As described with reference to FIG. 4, and FIGS. 11 to 13, whether the sheet conveyance is in the overlapped feeding state and in which pattern of the overlapped feeding state the sheet conveyance is, can be identified on the basis of the peak in the transition from the state A to the state B and the peak in the state B of the mechanical load torque applied to the motor gear shaft 310. In the first embodiment, the separation state of the sheet is determined on the basis of the mechanical load torque applied to the motor gear shaft 310 of the motor 11.

More specifically, the change in the mechanical load torque of the motor 11 corresponds to the change in the voltage value of the driving signal output from the driving unit 12 as described above. As illustrated in FIG. 2, the detection unit 16 monitors the driving output for the motor 11 and detects a change in the driving output as a feature amount. Specifically, the detection unit 16 monitors the voltage value obtained by integrating the driving signal, which is the PWM signal, supplied from the driving unit 12, for example, and detects the peak of the voltage value. The determination unit 17 determines whether the conveyance state is the overlapped feeding state and in which pattern of the overlapped feeding state the conveyance state is, on the basis of the feature amount detected by the detection unit 16.

The determination of whether the conveyance state is in the overlapped feeding state and in which pattern of the overlapped feeding state the conveyance state is, is not limited to being performed on the basis of a change in the mechanical load torque. As illustrated in FIG. 4, and FIGS. 11 to 13, the other parameters, i.e., the motor rotation speed and the motor rotation position deviation, are also changed corresponding to the change in the mechanical load torque, i.e., the motor driving output. The determination of whether the conveyance state is in the overlapped feeding state and in which pattern of the overlapped feeding state the conveyance state is, may be performed by combining the results of further detection of changes in the motor rotation speed and the motor rotation position deviation with the detection result of a change in the mechanical load torque. The combination of the detection results of changes in multiple parameters can highly accurately perform the determination of whether the conveyance state is in the overlapped feeding state and in which pattern of the overlapped feeding state the conveyance state is.

In the rush pattern, the sheet group including a lot of sheets is conveyed simultaneously or the sheets included in the sheet group are continuously conveyed with short intervals, thereby causing the separation roller 301 to be rotated in the conveyance direction by being pulled by the sheet group. As a result, the separation torque reaches the upper limit value. By further detecting the separation torque as the feature amount, the rush pattern in the overlapped feeding state can be highly accurately determined. The detection result of the rush pattern in the overlapped feeding state can be used as error information that indicates an abnormality in sheet separation condition and sheet setting condition. The detection results of the rush pattern in the overlapped feeding state may be stored. The stored detection results, thus, can be used as information used for eliminating failures in the conveyance system.

Figure 14:
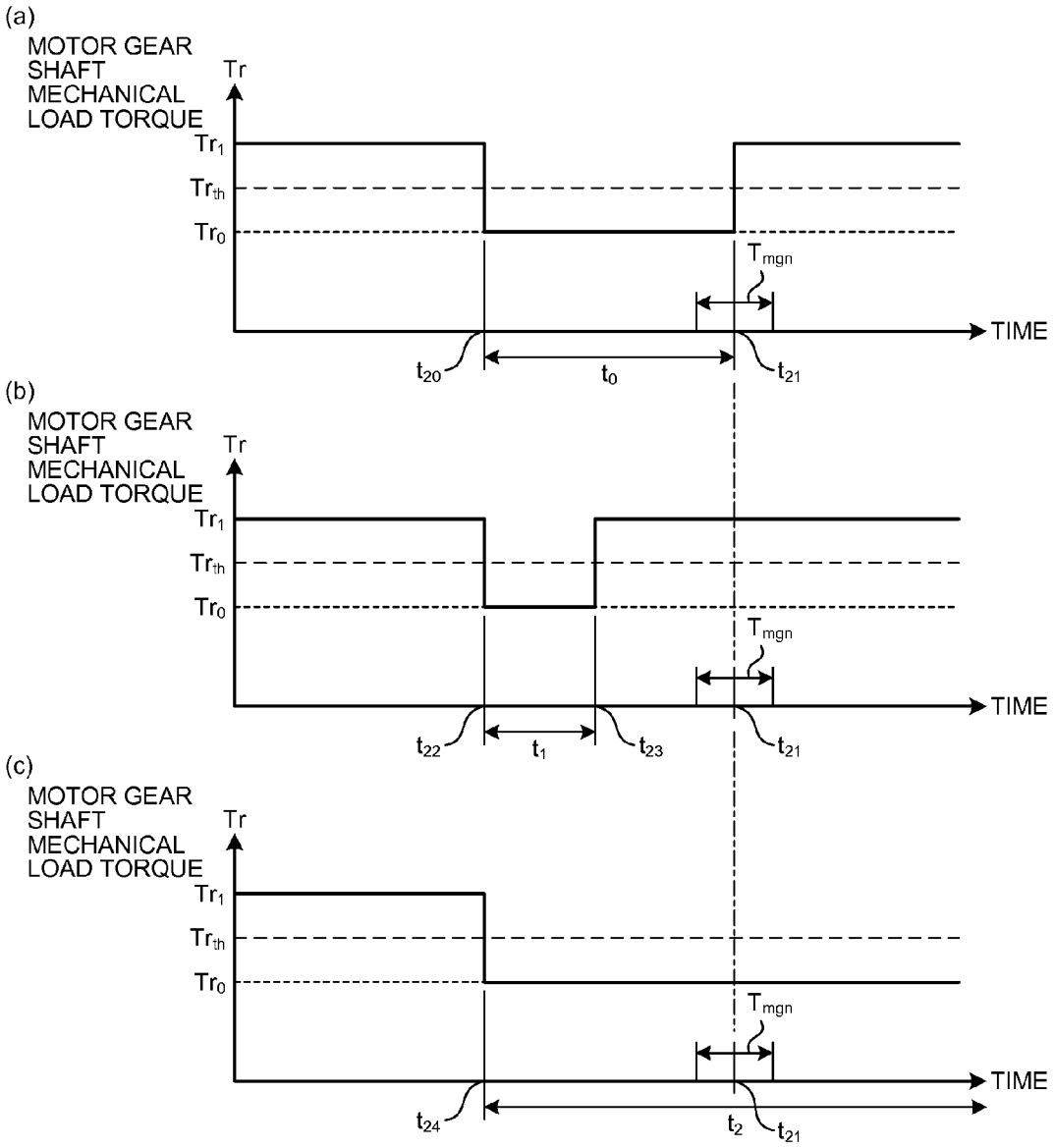
FIG. 14 is a schematic diagram to explain a method for determining the overlapped feeding tendency state and the non-feeding state according to the first embodiment.

The following describes a method for determining the overlapped feeding tendency state and the non-feeding state according to the first embodiment with reference to FIG. 14. In the following description, the structure illustrated in FIG. 3 is referred to as the mechanical structure and the structure illustrated in FIG. 2 is referred to as the functional structure of the separation conveyance device. In FIG. 14, the ordinate axes each represent the mechanical load torque applied to the motor gear shaft 310 and the abscissa axes each represent time. In FIG. 14, the peaks of the respective values in the transition from the state A to the state B, in the state B, and in the transition from the state B to the state C, which are described with reference to FIG. 4, and FIGS. 11 to 13, are omitted.

A section (a) of FIG. 14 illustrates an example of a temporal change in the mechanical load torque when the sheet is normally separated, i.e., no overlapped feeding and no non-feeding occurs. The torque value $Tr_0$ and the torque value $Tr_1$ are the same as those described with reference to FIG. 4. The detection unit 16 determines whether the mechanical load torque is any of the torque value $Tr_0$ and the torque value $Tr_1$ by comparing the mechanical load torque with a torque threshold $Tr_{th}$. Specifically, the detection unit 16 compares a voltage value obtained by integrating the driving signal, which is the PWM signal, supplied from the driving unit 12 with a threshold, for example, and determines that the mechanical load torque is the torque value $Tr_1$ when the voltage value exceeds the threshold and determines that the mechanical load torque is the torque value $Tr_0$ when the voltage value is equal to or smaller than the threshold.

The torque threshold $Tr_{th}$ can be set on the basis of the relation between the ratio of the torque value $Tr_0$ in the state A to the torque value $Tr_1$ in the state B of the mechanical load torque, and the ratio of the linear speed $v_1$ of the feed roller 300 to the linear speed $v_2$ of the conveyance roller 302. The relation is represented by expression (1). The torque threshold $Tr_{th}$ is preferably set by taking into consideration sheet separation performance, productivity, and detection accuracy of the mechanical load torque value required for the separation conveyance system. Specifically, if the value of the ratio of the linear speed $v_1$ of the feed roller 300 to the linear speed $v_2$ of the conveyance roller 302 is close to one, the difference between the torque values $Tr_0$ and $Tr_1$ of the mechanical load torque is small. As a result, it is difficult to set the torque threshold $Tr_{th}$. It is more preferable that a determinable torque difference is set by taking into consideration the detection variation of the mechanical load torque.

The sheet 320*c* that has been conveyed and has entered the conveyance roller 302 fully leaves the feed roller 300 at the time $t_{20}$. At the time, the mechanical load torque is changed from the torque value $Tr_1$ to the torque value $Tr_0$. After a certain time period from the time $t_{20}$, the next sheet 320*b* is picked up by the pick-up roller 311 and conveyed by the feed roller 300. The sheet 320*b* enters the conveyance roller 302 at a time $t_{21}$. In a time period $t_0$ from the time $t_{20}$ to the time $t_{21}$, the mechanical load torque is the torque value $Tr_0$.

The sheet 320*b* is conveyed by the feed roller 300, and then enters the conveyance roller 302 at the time $t_{21}$. At the time, the mechanical load torque is increased to the torque value $Tr_1$. When the sheet 320*b* is normally separated, the time period $t_0$ is a predetermined value. In this case, the distance (distance between sheets) between the sheets 320*c* and 320*b* is the distance $D_0$ illustrated in the section (d) of FIG. 3.

A section (b) of FIG. 14 illustrates an example of a temporal change in the mechanical load torque in the overlapped feeding tendency state. At the time (a time $t_{22}$) when the sheet 320*c* conveyed ahead fully leaves the feed roller 300 as illustrated in FIG. 9C, for example, the mechanical load torque is decreased to the torque value $Tr_0$ from the torque value $Tr_1$. The sheet 320*b* is picked up by the pick-up roller 311, and then enters the conveyance roller 302 at a time $t_{23}$. At the time, the mechanical load torque is increased to the torque value $Tr_1$ from the torque value $Tr_0$. The sheet 320*b* is originally picked up such that a certain distance between sheets is made between the sheet 320*c* conveyed ahead and the sheet 320*b*. When the sheets tend to be conveyed by being overlapped, the sheet 320*b* is conveyed together with the sheet 320*c*. As a result, the distance between the sheets 320*b* and 320*c* tends to be shorter than the certain distance between sheets. When a time period $t_1$ from the time $t_{22}$ to the time $t_{23}$ is shorter than the time period $t_0$, it can be determined that the separation state of the sheet is the overlapped feeding tendency state.

A section (c) of FIG. 14 illustrates an example of a temporal change in the mechanical load torque when the sheet fails to be fed (in the non-feeding state). In the non-feeding, the sheet 320*c* conveyed ahead fully leaves the feed roller 300 at a time $t_{24}$ as illustrated in FIG. 10. The next sheet 320*b* fails to enter the conveyance roller 302 even though a predetermined time period $t_2$ longer than the time period $t_0$ elapses as illustrated FIGS. 10B and 10C. The mechanical load torque is not increased to the torque value $Tr_1$ from the torque value $Tr_0$.

By measuring a time period $t_x$ during which the mechanical load torque is the torque value $Tr_0$, it can be determined whether the separation state of the sheet is any of the normal separation, the overlapped feeding state, and the non-feeding state. The time period $t_0$ in the normal sheet separation state is used as a reference value, for example. The determination is performed on the measured time period $t_x$ using expressions (2) to (4).

$$\text{Normal state: } t_x = t_0 \quad (2)$$

$$\text{Non-feeding tendency state: } t_x > t_0 \quad (3)$$

$$\text{Overlapped feeding tendency state: } t_x < t_0 \quad (4)$$

The determination unit 17 may provide an allowable time period $T_{mgn}$ that is a margin of a reference value M in the determination (refer to the sections (a) to (c) of FIG. 14). The determination is performed on the measured time period $t_x$ using expressions (5) to (7), for example.

$$\text{Non-feeding tendency state: } t_x > t_0 - (T_{mgn}/2) \quad (5)$$

$$\text{Overlapped feeding tendency state: } t_x < t_0 + (T_{mgn}/2) \quad (6)$$

$$\text{Normal state: } t_0 - (T_{mgn}/2) \leq t_x \leq t_0 + (T_{mgn}/2) \quad (7)$$

The determination unit 17 performs the determination by regarding the detection result of the driving signal output supplied from the detection unit 16 as the detection result of the mechanical load torque, for example. The determination is not limited to being performed as described above. For example, the determination unit 17 may calculate the mechanical load torque from the detection result of the driving signal output supplied from the detection unit 16 and perform the determination on the basis of the calculated mechanical load torque. For another example, the detection unit 16 may detect the motor rotation speed and the motor rotation position deviation on the basis of the output of the encoder of the motor 11, and the determination unit 17 may determine the sheet separation state additionally using the motor rotation speed and the motor rotation position deviation. The use of the various detection results makes it possible to highly accurately determine the sheet separation state.

Figure 15:
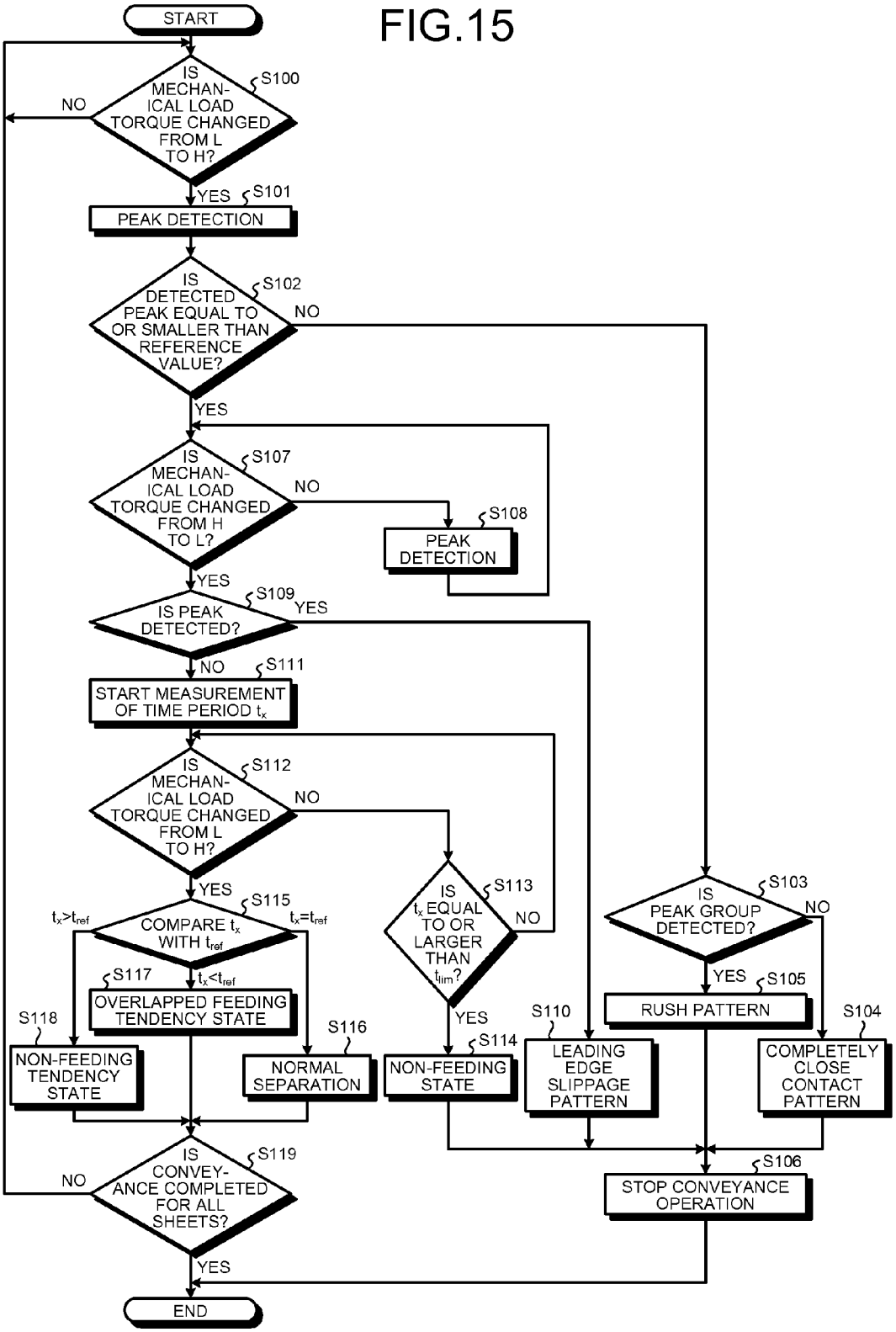
FIG. 15 is an exemplary flowchart illustrating determination processing in the separation conveyance device according to the first embodiment.

FIG. 15 is a flowchart illustrating an example of the determination processing in the separation conveyance device 10 according to the first embodiment.

The torque threshold $Tr_{th}$ is preliminarily set for the torque value Tr of the mechanical load torque applied to the motor 11 (the motor gear shaft 310). The detection unit 16 compares the torque value Tr with the torque threshold $Tr_{th}$. When determining that the torque value Tr is equal to or larger than the torque threshold $Tr_{th}$ as a result of the comparison, the detection unit 16 regards the torque value Tr as the torque value $Tr_1$, which is the torque value in the state B. When determining that the torque value Tr is smaller than the torque threshold $Tr_{th}$ as a result of the comparison, the detection unit 16 regards the torque value Tr as the torque value $Tr_0$, which is the torque value in the state A or C. In the flowchart of FIG. 15, the torque value $Tr_0$ is denoted as "L (low)" while the torque value $Tr_1$ is denoted as "H (high)".

The separation conveyance device 10 initializes the time period $t_x$ to zero prior to the start of the processing according to the flowchart of FIG. 15.

At step S100, the detection unit 16 determines whether the torque value Tr of the mechanical load torque is changed from "L" to "H". In other words, at step S100, the detection unit 16 determines whether or not the state of the mechanical load torque is changed from that in the state A to that in the state B. If it is determined that the torque value Tr is not changed, the detection unit 16 returns the processing to step S100. If it is determined that the torque value Tr of the mechanical load torque is changed from "L" to "H", the detection unit 16 causes the processing to proceed to step S101.

At step S101, the detection unit 16 detects a peak of the torque value Tr of the mechanical load torque in the transition from the state A to the state B. At step S102, the determination unit 17 compares the value of the peak detected by the detection unit 16 at step S101 with a predetermined reference value. As the reference value, the peak $P_0$ of the torque value Tr of the mechanical load torque in the transition from the state A to the state B when the sheet is separated normally, which is illustrated in the section (a) of FIG. 4, can be used, for example.

If it is determined that the peak value detected at step S101 is larger than the reference value, the determination unit 17 causes the processing to proceed to step S103. At step S103, the determination unit 17 determines whether or not the peak detected at step S101 is a peak group including a plurality of peaks. The detection unit 16 may perform peak detection continuously for a certain time period from the peak detection at step S101 to detect the peak group, for example.

If it is determined that the peak group is detected at step S103, the determination unit 17 causes the processing to proceed to step S105, at which the determination unit 17 determines that the separation state of the sheet is the rush pattern in the overlapped feeding state. The separation conveyance device 10, then, causes the processing to proceed to step S106, at which the separation conveyance device 10 stops the conveyance operation and ends the processing in the flowchart of FIG. 15.

If it is determined that no peak group is detected at step S103, the determination unit 17 causes the processing to proceed to step S104, at which the determination unit 17 determines that the separation state of the sheet is the completely close contact pattern. The separation conveyance device 10, then, causes the processing to proceed to step S106, at which the separation conveyance device 10 stops the conveyance operation and ends the processing in the flowchart of FIG. 15.

If it is determined that the peak value detected at step S101 is equal to or smaller than the reference value, at step S102, the determination unit 17 causes the processing to proceed to step S107. At step S107, the detection unit 16 determines whether or not the torque value Tr of the mechanical load torque is changed from "H" to "L". In other words, at step S107, the detection unit 16 determines whether or not the state of the mechanical load torque is changed from that in the state B to that in the state C.

If it is determined that the torque value Tr of the mechanical load torque is not changed from "H" to "L", the detection unit 16 causes the processing to proceed to step S108. At step S108, the detection unit 16 detects a peak of the torque value Tr of the mechanical load torque, and then returns the processing to step S107.

If it is determined that the torque value Tr of the mechanical load torque is changed from "H" to "L", at step S107, the detection unit 16 causes the processing to proceed to step S109. At step S109, the determination unit 17 determines whether a peak of the torque value Tr of the mechanical load torque is detected by the peak detection at step S108.

If it is determined that the peak of the torque value is detected at step S109, the determination unit 17 causes the processing to proceed to step S110, at which the determination unit 17 determines that the separation state of the sheet is the leading edge slippage pattern. The separation conveyance device 10, then, causes the processing to proceed to step S106, at which the separation conveyance device 10 stops the conveyance operation and ends the processing in the flowchart of FIG. 15.

If it is determined that no peak of the torque value is detected at step S109, the determination unit 17 causes the processing to proceed to step S111. At step S111, the detection unit 16 starts the measurement of the time period $t_x$. At step S112, the detection unit 16 determines whether or not the torque value Tr of the mechanical load torque is changed from "L" to "H". In other words, at step S112, the detection unit 16 determines whether or not the state of the mechanical load torque is changed from that in the state C to that in the next state A.

If it is determined that the torque value Tr of the mechanical load torque is not changed from "L" to "H", at step S112, the detection unit 16 causes the processing to proceed to step S113. At step S113, the determination unit 17 compares the measured time period $t_x$ with a predetermined upper limit value $t_{lim}$. If it is determined that the time period $t_x$ is smaller than the upper limit value tlim as the result of the comparison, the determination unit 17 returns the processing to step S112.

If it is determined that the time period $t_x$ is equal to or larger than the upper limit value $t_{lim}$ at step S113, the determination unit 17 causes the processing to proceed to step S114, at which the determination unit 17 determines that the separation state of the sheet is the non-feeding state. The separation conveyance device 10, then, causes the processing to proceed to step S106, at which the separation conveyance device 10 stops the conveyance operation and ends the processing in the flowchart of FIG. 15.

If it is determined that the torque value Tr of the mechanical load torque is changed from "L" to "H", at step S112, the detection unit 16 causes the processing to proceed to step S115. At step S115, the determination unit 17 compares the measured time period $t_x$ with a predetermined reference value $t_{ref}$. The reference value $t_{ref}$ is a time period obtained by adding the allowable time period $T_{mgn}$ to the time period $t_0$ when the separation is normally performed, which is represented in expressions (5) to (7). If it is determined that the time period $t_x$ is equal to the reference value $t_{ref}$, i.e., the time period $t_x$ satisfies expression (7), the determination unit 17 causes the processing to proceed to step S116, at which the determination unit 17 determines that the separation is performed normally. The separation conveyance device 10, then, causes the processing to proceed to step S119.

If it is determined that the time period $t_x$ is smaller than the reference value $t_{ref}$, the time period $t_x$ satisfies expression (6), at step S115, the determination unit 17 causes the processing to proceed to step S117, at which the determination unit 17 determines that the separation state of the sheet is the overlapped feeding tendency state. The separation conveyance device 10, then, causes the processing to proceed to step S119.

If it is determined that the time period $t_x$ is larger than the reference value $t_{ref}$, i.e., the time period $t_x$ satisfies expression (5), at step S115, the determination unit 17 causes the processing to proceed to step S118, at which the determination unit 17 determines that the separation state of the sheet is the non-feeding tendency state. The separation conveyance device 10, then, causes the processing to proceed to step S119.

At step S119, the separation conveyance device 10 determines whether the conveyance is completed for all of the sheets. If it is determined that the conveyance is not completed for all of the sheets, the separation conveyance device 10 initializes the time period $t_x$ to zero, and returns the processing to step S100. If it is determined that the conveyance is completed for all of the sheets, the separation conveyance device 10 stops the conveyance operation and ends the processing in the flowchart of FIG. 15.

In the first embodiment, the sheet separation state is determined using information about the driving of the motor 11. As a result, it is unnecessary to provide an optical sensor dedicated to determining the separation state. In addition, information about the motor 11 that drives the driving system for separation and conveyance of the sheet is used, thereby making it possible to determine the separation state at a stage prior to the sheet registration. As a result, the sheet is prevented from being conveyed after being separated abnormally. The sheet conveyed after being separated abnormally may cause jamming or breakage of the sheet, thereby causing the deterioration of jam release performance (ease of removing the jammed sheet). The first embodiment can find an abnormal separation of the sheet in an early stage and perform the stop processing, thereby achieving excellent maintainability.

In the first embodiment, the separation state of the sheet 320 is determined using the switching of the route along which the separation torque is transmitted to the motor gear shaft 310 in the conveyance process of the sheet 320. As a result, an influence of the thickness of the sheet 320 on the determination result of the separation state can be reduced.

In the flowchart, the time period $t_x$ is measured at step S111 and the determination processing is performed at step S113 and step S115 on the basis of the measured time period $t_x$. The item to be measured is not limited to the example. For example, a rotation amount (movement amount) of the motor 11 may be measured from the output of the encoder included in the motor 11 at step S111 and the determination may be performed at step S113 and step S115 on the basis of the measured rotation amount.

The allowable time period $T_{mgn}$ is described as the fixed value. The allowable time period $T_{mgn}$ is not limited to the fixed value. For example, the allowable time period $T_{mgn}$ can be changed in accordance with the type of sheet, which is indicated by the thickness of, the size of, and the surface flatness of the sheet, and individual differences between mechanical structures. The torque threshold $Tr_{th}$ is described as the fixed value. The torque threshold $Tr_{th}$ is not limited to the fixed value. For example, the torque threshold $Tr_{th}$ can also be changed in accordance with the type of sheet, which is indicated by the thickness of, the size of, and the surface flatness of the sheet, and individual differences between mechanical structures.

In the flowchart, if it is determined that the separation state of the sheet is the non-feeding state at step S114, the conveyance operation is stopped. The processing after the determination is not limited to the stop of the conveyance operation. For example, the conveyance of the sheet can be re-tried if it is determined that the separation state of the sheet is the non-feeding state at step S114.

If it is determined that the separation state of the sheet is the non-feeding tendency state at step S117 and if it is determined that the separation state of the sheet is the overlapped feeding tendency state in step S118, the separation conveyance device 10 may store the measured time period $t_x$ for each case and tally the stored time periods. The separation conveyance device 10 can determine whether the overlapped feeding state or the non-feeding state may be caused by the aging factors in the separation conveyance device 10 on the basis of the total result. This determination makes it possible to take actions such as a maintenance of the device before the overlapped feeding or the non-feeding actually occurs. For example, when it is determined that there is a strong tendency of the overlapped feeding, the separation roller 301 and the feed roller 300 may be worn.

The determination is performed by comparing the torque value Tr and the torque threshold $Tr_{th}$ as described above. The determination is not limited to being performed as described in this example. For example, a difference value between the torque value Tr and the torque threshold $Tr_{th}$ may be further acquired and the difference value may be finally taken into consideration for determination of the sheet separation state. The last sheet may be detected using the fact that the separation torque exceeds the set upper limit value when the last sheet is separated.

The determination is performed on the basis of the torque value Tr of the mechanical load torque as described above. The determination is not limited to being performed as described in this example. For example, the determination may be performed on the basis of the peaks or the valleys (peaks on the negative side) of the motor rotation speed and the motor rotation position deviation with reference to FIG. 4 and FIGS. 11 to 13. Furthermore, the determination can be performed by combining the items described above.

Second Embodiment

The following describes a second embodiment of the present invention. The second embodiment is an example where the first embodiment is applied to a multifunction printer (MFP). The MFP is a multifunction peripheral that can achieve multiple functions such as a printer function, a scanner function, and a copying function in a single housing.

The MFP includes an image forming mechanism that forms an image on a sheet in accordance with image data and a scanner mechanism that reads an image from a document, for example. The MFP achieves the printer function, the scanner function, and the copying function in a single housing by combining or singly using the image forming mechanism and the scanner mechanism. The MFP can further include a communication unit that performs data communication, and further achieve a fax function by combining the printer function, the scanner function, the copying function, and the communication function of the communication unit.

Figure 16:
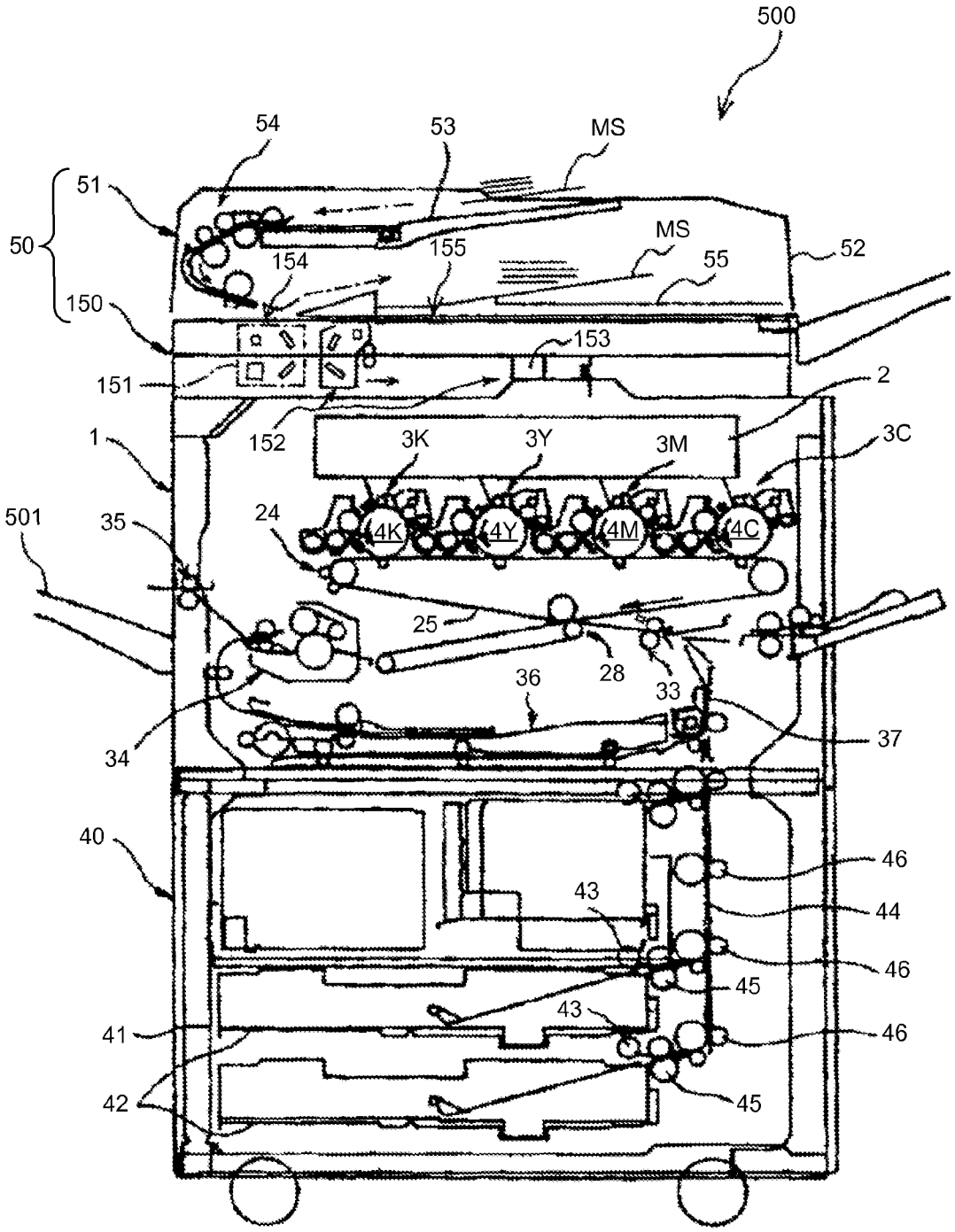
FIG. 16 is a schematic diagram illustrating an exemplary structure of a multifunction printer (MFP) applicable to a second embodiment.

FIG. 16 illustrates an example of the MFP applicable to the second embodiment. In FIG. 16, an MFP 500 is a copying machine that allows the printer function, the scanner function, and the copying function to be used.

As illustrated in FIG. 16, the MFP 500 includes an image forming unit 1 serving as an image forming device, a transfer sheet supply device 40, and an image reading unit 50. The image reading unit 50 serving as an image reading device includes a scanner 150 fixed on the image forming unit 1 and an automatic document feeder (ADF) 51 serving as a sheet conveyance device supported by the scanner 150.

The transfer sheet supply device 40 includes two transfer sheet feeding cassettes 42 arranged in multiple steps in a paper bank 41, transfer sheet sending rollers 43 each feeding the transfer sheets from the corresponding transfer sheet feeding cassette 42, and transfer sheet separation rollers 45 each separating the sheet from the fed sheets to supply the sheet to a transfer sheet feeding path 44. A plurality of conveyance rollers 46 that convey the transfer sheet (sheet) are included in a main body side transfer sheet feeding path 37 serving as a conveyance path in the image forming unit 1. The transfer sheet supply device 40 feeds the transfer sheet in the transfer sheet feeding cassette 42 to the main body side transfer sheet feeding path 37 in the image forming unit 1.

The image forming unit 1 includes a light writing device 2, four process units 3K, 3Y, 3M, and 3C that form toner images of respective colors of black (K), yellow (Y), magenta (M), and cyan (C), a transfer unit 24, a sheet conveyance unit 28, a registration roller pair 33, a fixing device 34, a switchback device 36, and the main body side transfer sheet feeding path 37. The image forming unit 1 drives a light source disposed inside the light writing device 2 to emit laser light toward four drum-shaped photoconductors 4K, 4Y, 4M, and 4C. The light source is a laser diode, for example, and is not illustrated in FIG. 16. Electrostatic latent images are formed on the surfaces of the photoconductors 4K, 4Y, 4M, and 4C by the laser light irradiation. The latent images are developed into toner images after being subjected to a predetermined developing process.

The transfer unit 24 is disposed below the four process units 3K, 3Y, 3M, and 3C. In the transfer unit 24, an intermediate transfer belt 25 that is stretched and supported by a plurality of rollers is endlessly moved clockwise in FIG. 16 while being in contact with the photoconductors 4K, 4Y, 4M, and 4C. As a result, primary transfer nips for the respective colors of K, Y, M, and C are formed where the photoconductors 4K, 4Y, 4M, and 4C and the intermediate transfer belt 25 are abutted.

Near the primary transfer nips of the respective colors of K, Y, M, and C, primary transfer rollers press the intermediate transfer belt 25 toward the respective photoconductors 4K, 4Y, 4M, and 4C. The primary transfer rollers are disposed inside the belt loop at positions corresponding to the respective photoconductors 4K, 4Y, 4M, and 4C. To each of the primary transfer rollers, a primary transfer bias is applied by a power source, which is not illustrated. As a result, primary transfer electric fields are formed at the primary transfer nips of the respective colors of K, Y, M, and C. The primary transfer electric fields electrostatically move the toner images on the photoconductors 4K, 4Y, 4M, and 4C toward the intermediate transfer belt 25. The respective toner images are primarily transferred onto the front surface of the intermediate transfer belt 25 to overlap with one another while the intermediate transfer belt 25 sequentially passes the primary transfer nips of the respective colors of K, Y, M, and C by being endlessly moved clockwise in FIG. 16. As a result of the primary transfer by overlapping the respective toner images with one another, the overlapped toner images of four colors (hereinafter described as the four-color toner image) are formed on the front surface of the intermediate transfer belt 25.

The sheet conveyance unit 28 is disposed below the transfer unit 24. The sheet conveyance unit 28 endlessly moves an endless sheet conveyance belt that is stretched between a driving roller and a secondary transfer roller. The intermediate transfer belt 25 and the sheet conveyance belt of the sheet conveyance unit 28 are sandwiched between the secondary transfer roller of the sheet conveyance unit 28 and a lower stretching roller of the transfer unit 24. As a result, a secondary transfer nip is formed where the front surface of the intermediate transfer belt 25 and the front surface of the sheet conveyance belt are abutted. To the secondary transfer roller, a secondary transfer bias is applied by a power source. The lower stretching roller of the transfer unit 24 is grounded. As a result, a secondary transfer electric field is formed at the secondary transfer nip.

The registration roller pair 33 is disposed on the right side of the secondary transfer nip in FIG. 16. Near the entrance of a registration nip of the registration roller pair 33, a registration roller sensor (not illustrated) is disposed. The conveyance of the transfer sheet conveyed from the transfer sheet supply device 40 toward the registration roller pair 33 is stopped after a certain time period from when the leading edge of the sheet is detected by the registration roller sensor. The leading edge, thus, abuts the registration nip of the registration roller pair 33. As a result, a posture of the transfer sheet is corrected and ready for synchronization with the image forming operation.

When the leading edge of the transfer sheet abuts the registration nip, the registration roller pair 33 starts the rotation again at such timing that the transfer sheet can be synchronized with the four-color toner image on the intermediate transfer belt 25, and feeds the transfer sheet to the secondary transfer nip. In the secondary transfer nip, the four-color toner image on the intermediate transfer belt 25 is secondarily transferred onto the transfer sheet collectively under the secondary transfer electric field and a nip pressure, thereby forming a full color image including white of the transfer sheet on the transfer sheet. The transfer sheet after passing through the secondary transfer nip is separated from the intermediate transfer belt 25 and conveyed to the fixing device 34 by the endless movement of the sheet conveyance belt while being held on the front surface of the sheet conveyance belt.

On the front surface of the intermediate transfer belt 25 after passing through the secondary transfer nip, transfer residual toner, which is not transferred onto the transfer sheet at the secondary transfer nip, is attached. The transfer residual toner is scraped and removed by a cleaning member using a belt cleaning device, which abuts the intermediate transfer belt 25.

The transfer sheet conveyed to the fixing device 34 is subjected to fixing processing with pressure and heat in the fixing device 34 to fix the full-color image. Then, the transfer sheet is conveyed to a sheet ejection roller pair 35 from the fixing device 34. The transfer sheet is ejected from the sheet ejection roller pair 35 to a sheet ejection tray 501 provided outside the MFP 500.

The switchback device 36 serving as a transfer sheet reversing device is disposed below the sheet conveyance unit 28 and the fixing device 34. When both-side printing is performed, the conveyance path of the transfer sheet, one surface of which has been subjected to the image fixing processing, is switched to the switchback device 36 side by a switching claw. The transfer sheet is reversed by the switchback device 36 and then enters the secondary transfer nip again. The secondary transfer processing and the fixing processing are performed on the other surface of the transfer sheet. Thereafter, the transfer sheet is ejected onto the sheet ejection tray 501.

The image reading unit 50, which includes the scanner 150 fixed on the image forming unit 1 and the ADF 51 fixed on the scanner 150, has a moving reading section 152 and fixed reading sections. The moving reading section 152 is disposed just below a second contact glass 155 that is fixed on the upper wall of the housing of the scanner 150 such that the second contact glass 155 is in contact with a document MS. The moving reading section 152 includes an optical system composed of a light source and reflection mirrors, for example, and can move the optical system in the right and left directions in FIG. 16. During the movement of the optical system from the left to the right in FIG. 16, light emitted from the light source is reflected by the underside of the document MS (not illustrated) placed on the second contact glass 155, and received by an image reading sensor 153 fixed to the scanner 150 after traveling via the multiple reflection mirrors.

The image reading unit 50 has a first fixed reading section 151 disposed in the scanner 150 and a second fixed reading section, which is described later, disposed in the ADF 51 as the fixed reading sections. The first fixed reading section 151 has a light source, reflection mirrors, and an image reading sensor of a charge coupled device (CCD), and is disposed just below a first contact glass 154 that is fixed on the upper wall of the housing of the scanner 150 such that the first contact glass 154 is in contact with the document MS. In the first fixed reading section 151, light emitted from the light source is sequentially reflected by a first surface of the document MS when the document MS conveyed by the ADF 51 passes over the first contact glass 154, and the reflected light enters the image reading sensor 153 after traveling via the multiple reflection mirrors. In this way, the first fixed reading section 151 scans the first surface of the document MS without moving the optical system composed of the light source and the reflection mirrors, for example. The second fixed reading section scans a second surface of the document MS after passing through the first fixed reading section 151.

The ADF 51 disposed on the scanner 150 includes, in a main body cover 52, a document placement table 53 on which the document MS before being read is placed, a document conveyance section 54 that conveys the document MS, and a document stack table 55 on which the documents MS after being read are stacked. The main body cover 52 is supported by a hinge fixed to the scanner 150 such that the main body cover 52 can be opened in the upper direction and closed in the lower direction. When the main body cover 52 is opened, the first contact glass 154 and the second contact glass 155, which are on the upper surface of the scanner 150, are exposed.

When the document is a one-file document in which one side of a bundle of documents is filed such as a bounded book, the bundle of documents cannot be separated one by one. Thus, the ADF 51 cannot be used for the conveyance of the document. When the one-file document needs to be read, the ADF 51 is opened, and then the one-file document is placed on the second contact glass 155 in such a manner that two facing pages including a page to be read are open and faced downward, and then the ADF 51 is closed. Thereafter, the image of the page is read by the moving reading section 152 of the scanner 150.

When a bundle of documents in which a plurality of individual documents MS are simply stacked is read, the documents MS can be separated and conveyed by the ADF 51 one by one and can be sequentially read by the first fixed reading section 151 in the scanner 150 and the second fixed reading section in the ADF 51. In this case, a bundle of documents is set on the document placement table 53, and then the ADF 51 sequentially separates the documents MS from the uppermost document MS in the bundle of documents placed on the document placement table 53 to feed the documents MS one by one into the document conveyance section 54, in which the fed document MS is reversed and conveyed toward the document stack table 55. In the conveyance operation, the document MS just after being reversed passes just over the first fixed reading section 151 of the scanner 150. At that time, the image on the first surface of the document MS is read by the first fixed reading section 151 of the scanner 150.

Figure 17:
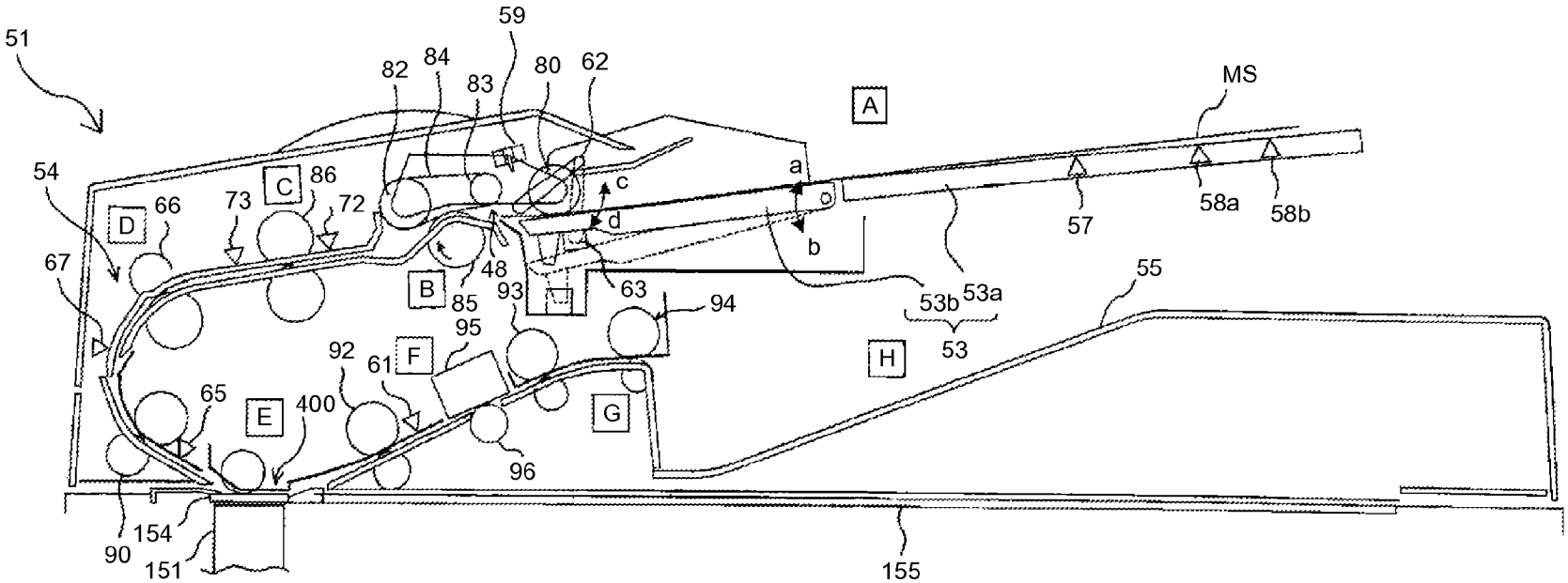
FIG. 17 is a schematic diagram illustrating in more detail an exemplary structure of an automatic document feeder (ADF) applicable to the second embodiment.

FIG. 17 illustrates an exemplary structure of the ADF 51 applicable to the second embodiment in detail together with the upper portion of the scanner 150. The ADF 51 includes a document set section A, a separation conveyance section B, a registration section C, a turning section D, a first reading conveyance section E, a second reading conveyance section F, a sheet ejection section G, and a stack section H.

The document set section A has the document placement table 53 on which a bundle of the documents MS is set such that the first surfaces of the documents MS face upward. The separation conveyance section B separates the documents MS one by one from the bundle of the documents MS set on the document placement table 53 and feeds the separated document MS. The separation conveyance section B corresponds to the separation conveyance device 10 described in the first embodiment and its modifications.

The registration section C abuts the fed document MS as a temporal stop to register the posture of the document MS and thereafter feeds the document MS. The turning section D has a C-shaped curved conveyance section. The turning section D reverses the front and the back surfaces of the document MS such that the first surface of the document MS faces downward while turning the conveyance direction of the document MS in the curved conveyance section. The first reading conveyance section E causes the first fixed reading section 151 disposed in the scanner 150 to read the first surface of the document MS from below the first contact glass 154 while conveying the document MS over the first contact glass 154.

The second reading conveyance section F causes a second fixed reading section 95 to read the second surface of the document MS while conveying the document MS by a second reading roller 96 disposed below the second fixed reading section 95. The sheet ejection section G ejects the document MS, from both surfaces of which the images have been read, toward the stack section H. The stack section H stacks the documents MS after being read on the document stack table 55.

The documents MS to be read are placed and set on the document placement table 53 such that the first surfaces of the documents MS face upward. The document placement table 53 is composed of a movable document table 53*b* that supports the leading edge portions of the documents and can be swung in the directions indicated with arrows a and b in accordance with the thickness of the bundle of the documents MS, and a fixed document table 53*a* that supports the rear edge portions of the documents. The documents MS are positioned on the document placement table 53 in the width direction of the documents MS, i.e., the direction perpendicular to the conveyance direction of the documents MS, by side guides (not illustrated) abutting the corresponding both edges of the documents MS in the width direction.

The documents MS thus set on the document placement table 53 push up a set filler 62 that serves as a lever and is swingably disposed above the movable document table 53*b*. With the pushing up of the set filler 62, a document set sensor 63 detects the setting of the documents MS and transmits a detection signal to a controller, which is not illustrated. The detection signal is transmitted from the controller to a main body control unit, which is not illustrated.

On the fixed document table 53*a*, document length sensors 57, 58*a*, and 58*b* are arranged. The document length sensors 57, 58*a*, and 58*b* are reflective photo sensors that detect the length of the document MS in the conveyance direction or actuator type sensors that can detect only one document. The approximate length of the document MS in the conveyance direction is determined by the document length sensors.

Above the movable document table 53*b*, a pick-up roller 80 is disposed. The pick-up roller 80 corresponds to the pick-up roller 311 illustrated in FIGS. 3A to 3D. The movable document table 53*b* is swung in the directions indicated with arrows a and b in FIG. 17 by a cam mechanism, which is driven by a bottom plate lifting motor, which is not illustrated. When the set filler 62 and the document set sensor 63 detect that the documents MS have been set on the document placement table 53, the controller causes the bottom plate lifting motor to rotate forward so as to lift up the movable document table 53*b* such that the uppermost surface of the bundle of the documents MS is in contact with the pick-up roller 80.

The pick-up roller 80 can be moved in the directions indicated with arrows c and d in FIG. 17 by a cam mechanism driven by a pick-up lifting motor, which is not illustrated. The pick-up roller 80 is lifted in the direction indicated with the arrow c in FIG. 17 by being pushed by the uppermost surface of the documents MS on the movable document table 53*b* when the movable document table 53*b* is lifted. The lift of the pick-up roller 80 is detected by a table lifting sensor 59. The table lifting sensor 59 detects that the movable document table 53*b* is lifted to the upper limit of the lift thereof. When the upper limit of the lift is detected, the pick-up lifting motor stops and the bottom plate lifting motor (not illustrated) stops.

In response to the user's operation to start reading the documents MS, a pick-up conveyance motor is driven to rotate the pick-up roller 80. The pick-up roller 80 picks up one to several documents MS on the document placement table 53. The pick-up roller 80 rotates in such a direction that the uppermost document MS in the multiple documents MS is conveyed to a sheet feeding inlet 48.

The document MS fed by the pick-up roller 80 enters the separation conveyance section B, in which the document MS is fed to an abutment position where the document MS abuts a sheet feeding belt 84. The sheet feeding belt 84 is stretched between a driving roller 82 and a driven roller 83. The sheet feeding belt 84 is endlessly moved clockwise in FIG. 17 by the driving roller 82 rotated by a sheet feeding motor that rotates forward. The structure including the sheet feeding belt 84, the driving roller 82, and the driven roller 83 corresponds to the feed roller 300 illustrated in FIG. 1.

A reverse roller 85 that is driven to rotate clockwise in FIG. 17 by the sheet feeding motor rotating forward abuts a lower stretching surface of the sheet feeding belt 84. The reverse roller 85 corresponds to the separation roller 301 illustrated in FIG. 1. The surface of the sheet feeding belt 84 moves in a sheet feeding direction at the abutment part where the reverse roller 85 abuts the sheet feeding belt 84. In contrast, the surface of the reverse roller 85 tends to move in the direction opposite to the sheet feeding direction. The driving transmission section of the reverse roller 85 is provided with a torque limiter (not illustrated). When a force in the sheet feeding direction is larger than the set torque of the torque limiter, the reverse roller 85 rotates such that the surface of the reverse roller 85 moves in the sheet feeding direction.

The reverse roller 85 abuts the sheet feeding belt 84 with a certain pressure. When the reverse roller 85 directly abuts the sheet feeding belt 84 or only one document MS is sandwiched at the abutment part in the case described above, the reverse roller 85 rotates in the dragged rotation state by the sheet feeding belt 84 or the document MS. When the multiple documents MS are sandwiched at the abutment part, the force applied by the documents MS to rotate the reverse roller 85 in the dragged rotation state is reduced to be smaller than the set torque of the torque limiter, thereby causing the reverse roller 85 to rotate clockwise in FIG. 17. The direction of rotating clockwise is opposite to the direction when the reverse roller 85 rotates in the dragged rotation state by the document MS. As a result, the reverse roller 85 applies a movement force to the documents MS below the uppermost document MS in the direction opposite to the sheet feeding direction, thereby separating only the uppermost document MS from the other documents MS. The overlapped feeding is thus prevented.

The document MS separated by the action of the sheet feeding belt 84 and the reverse roller 85 enters the registration section C. The document MS is further fed by the sheet feeding belt 84 and then the leading edge of the document MS is detected by an abutting sensor 72. The document MS is further fed and abuts a pullout roller pair 86 that has stopped the rotation thereof. A sheet feeding motor is driven for a certain time period from the detection of the leading edge by the abutting sensor 72, and then stopped. The rotation of the sheet feeding motor 102 results in the document MS being fed by a certain determined distance from the position at which the leading edge is detected by the abutting sensor 72. As a result, the conveyance of the document MS by the sheet feeding belt 84 is stopped in the state where the document MS is pushed to the pullout roller pair 86 with a certain amount of deflection.

When the leading edge of the document MS is detected by the abutting sensor 72, the pick-up roller 80 is retracted from the upper surface of the document MS by rotating the pick-up lifting motor, resulting in the document MS being fed by only the conveyance force of the sheet feeding belt 84. As a result, the leading edge of the document MS enters a nip formed by the upper and the lower rollers of the pullout roller pair 86 and the leading edge is aligned (skew correction).

The pullout roller pair 86 has the skew function as described above and conveys the document MS subjected to the skew correction after the separation to an intermediate roller pair 66. The pullout roller pair 86 corresponds to the conveyance roller 302 illustrated in FIG. 1. In the second embodiment, the driving roller 82 and the pullout roller pair 86 are driven by a single motor (not illustrated) corresponding to the motor 11 illustrated in FIG. 2. The driving system that drives the driving roller 82 and the pullout roller pair 86 is driven by a single motor controlled by a mechanism corresponding to the driving system of the separation conveyance device 10 described with reference to FIG. 1.

The document MS fed by the pullout roller pair 86 passes through just below a document width sensor 73. The document width sensor 73 is composed of a plurality of sheet detection sensors such as reflection photo sensors arranged in the document width direction (the direction perpendicular to the conveyance direction) and detects the size of the document MS in the width direction on the basis of whether which sheet detection sensor detects the document MS. The length of the document MS in the conveyance direction is detected from the motor pulse counts on the basis of a time period from when the leading edge of the document MS is detected by the abutting sensor 72 until the document MS is not detected by the abutting sensor 72 (until the rear edge of the document MS fully passes through the abutting sensor 72).

The document MS conveyed by the pullout roller pair 86 and the intermediate roller pair 66 enters the turning section D in which the document MS is conveyed by the intermediate roller pair 66 and a reading entrance roller pair 90. The intermediate roller pair 66 is configured to be driven by both of a pullout motor serving as the driving source of the pullout roller pair 86 and a reading entrance motor serving as the driving source of the reading entrance roller pair 90. A mechanism is provided in which the rotation speed of the intermediate roller pair 66 is determined by being driven by one motor having a higher rotation speed than that of the other motor.

In the image reading unit 50, when the document MS is conveyed from the registration section C to the turning section D by driving the pullout roller pair 86 and the intermediate roller pair 66 to rotate, a conveyance speed in the registration section C is set higher than a conveyance speed in the first reading conveyance section E so as to reduce time taken for processing to feed the document MS to the first reading conveyance section E. In this case, the intermediate roller pair 66 is rotated by the pullout motor as the driving source.

When the leading edge of the document MS is detected by a reading entrance sensor 67, the reduction of the rotation speed of the pullout motor starts so as to synchronize the conveyance speed of the document MS with the conveyance speed of the document MS in the first reading conveyance section E before the leading edge of the document MS enters a nip formed by the upper and the lower rollers of the reading entrance roller pair 90. At the same time, the reading entrance motor and a reading motor are driven to rotate forward. The reading entrance motor driven to rotate forward drives the reading entrance roller pair 90 to rotate so as to convey the document MS in the conveyance direction. The reading motor driven to rotate forward drives a reading exit roller pair 92 and a second reading exit roller pair 93 so as to convey the document MS in the conveyance direction.

When the leading edge of the document MS conveyed from the turning section D toward the first reading conveyance section E is detected by a registration sensor 65, the controller reduces the rotation speeds of the respective motors by taking a certain time period, thereby reducing the conveyance speed of the document MS in a certain conveyance distance. The controller performs control such that the document MS stops before a first reading position 400 of the first fixed reading section 151, and transmits a registration stop signal to the main body control unit.

When receiving a reading start signal from the main body control unit, the controller controls the reading entrance motor and the reading motor such that the conveyance speed of the document MS is increased to a certain conveyance speed before the leading edge of the document MS, which is in the registration stop state, reaches the first reading position 400. As a result, the conveyance speed of the document MS is increased and the document MS is conveyed toward the first reading position 400. At a timing when the leading edge of the document MS reaches the first reading position 400, the controller transmits a gate signal that indicates an effective image area in the sub-scanning direction on the first surface of the document MS to the main body control unit. The timing is calculated on the basis of the pulse counts of the reading entrance motor. The transmission of the gate signal continues until the rear edge of the document MS fully leaves the first reading position 400, and thus the first surface of the document MS is read by the first fixed reading section 151.

The document MS after passing through the first reading conveyance section E passes through the nip of the reading exit roller pair 92. Thereafter, the leading edge of the document MS is detected by a sheet ejection sensor 61. Thereafter, the document MS is conveyed through the second reading conveyance section F to the sheet ejection section G.

When only one surface (the first surface) of the document MS is read, it is unnecessary to read the second surface of the document MS by the second fixed reading section 95. When the leading edge of the document MS is detected by the sheet ejection sensor 61, a sheet ejection motor is driven to start rotating forward and the upper sheet ejection roller of the sheet ejection roller pair 94 is driven to rotate counterclockwise in FIG. 17. A timing when the rear edge of the document MS fully leaves the sheet ejection roller pair 94 is calculated on the basis of the pulse counts of the sheet ejection motor from the detection of the leading edge of the document MS by the sheet ejection sensor 61. On the basis of the calculation result, control is performed such that, at a timing just before the rear edge of the document MS fully leaves the sheet ejection roller pair 94, the driving speed of the sheet ejection motor is reduced to a speed with which the document MS is ejected so as not to jump out of the document stack table 55.

When both surfaces (the first and the second surfaces) of the document MS are read, a timing when the document MS reaches the second fixed reading section 95 after the detection of the leading edge of the document MS by the sheet ejection sensor 61 is calculated on the basis of the pulse counts of the reading motor. At the calculated timing, the controller transmits a gate signal that indicates an effective image area in the sub-scanning direction on the second surface of the document MS to the main body control unit. The transmission of the gate signal continues until the rear edge of the document MS fully leaves the second reading section 95, and thus the second surface of the document MS is read by the second fixed reading section 95.

The second reading section 95 comprises a contact image sensor (CIS), for example. The reading surface of the second reading section 95 is subjected to coating processing for the purpose of preventing reading vertical stripes due to the sticking of a pasty foreign material adhering to the document MS to the reading surface. At a position opposite the second fixed reading section 95 with the conveyance path, through which the document MS passes, interposed therebetween, a second reading roller 96 is disposed that serves as a document supporting section supporting the document MS from a non-reading surface side (on the first surface side). The second reading roller 96 plays a role to prevent the document MS from being floated at a second reading position of the second fixed reading section 95 and to function as a reference white area for acquiring shading data by the second fixed reading section 95.

Figure 18:
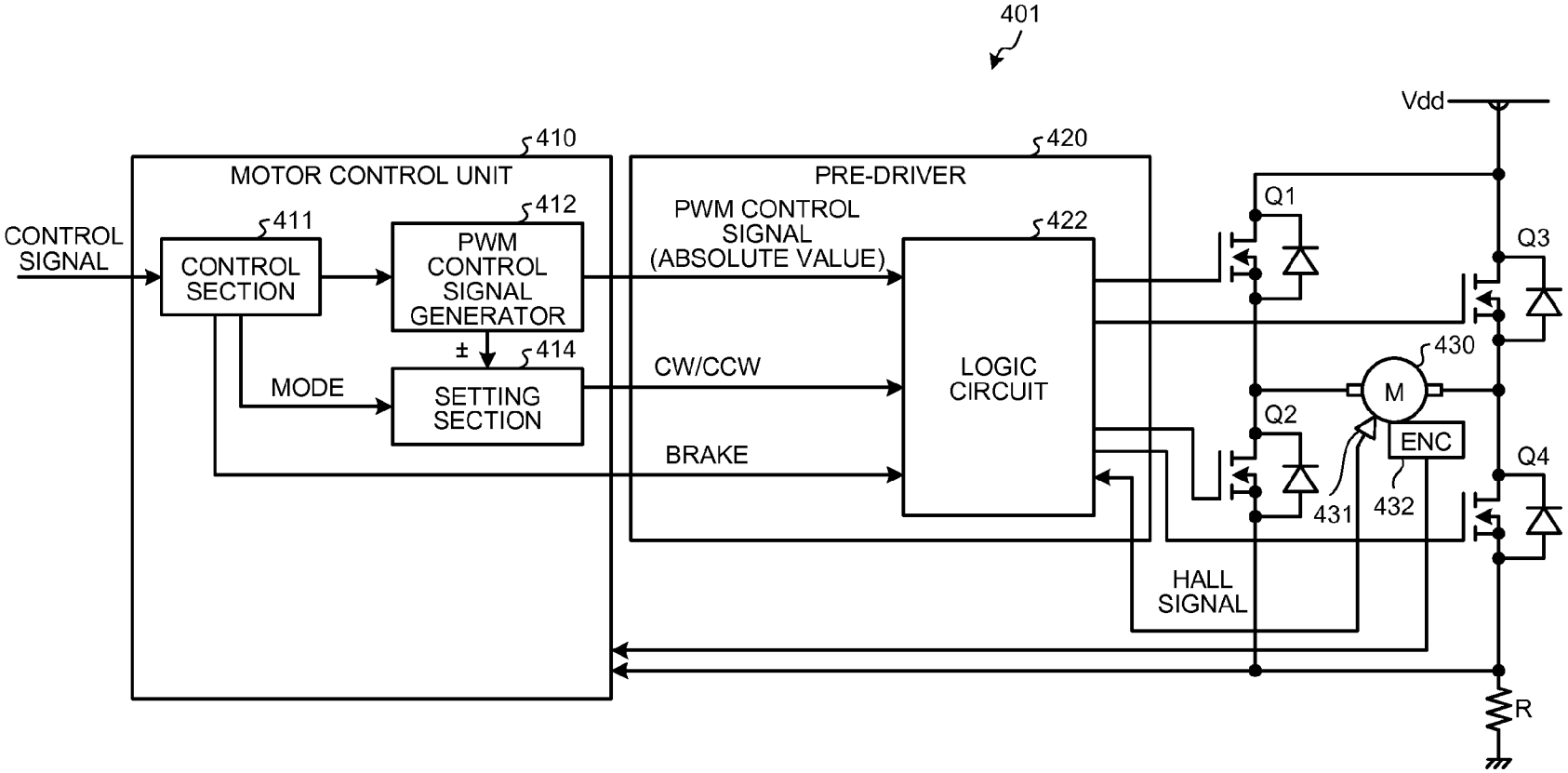
FIG. 18 is a block diagram illustrating an exemplary structure of a motor control system applicable to the second embodiment.

FIG. 18 illustrates an exemplary structure of a control system that controls the motor driving both of the driving roller 82 and the pullout roller pair 86 and is applicable to the second embodiment. As illustrated in FIG. 18, a motor control system 401 includes a motor control unit 410, a pre-driver 420, a motor (M) 430, a Hall element 431, an encoder (ENC) 432, and a circuit that drives the motor 430. The motor 430 drives both of the driving roller 82 and the pullout roller pair 86. The pre-driver 420 is included in the motor 11 illustrated in FIG. 2. The motor control unit 410 may be included in the driving unit 12.

In the motor control system 401, pre-driver 420 outputs a motor driving signal on the basis of a driving control signal and an operation control signal that are produced by the motor control unit 410. The motor driving signal drives the motor 430 and controls the rotation of the motor 430.

The motor control unit 410 includes a control section 411, a PWM control signal generator 412, and a setting section 414. The control section 411 includes a part of the driving unit 12, the detection unit 16, and the determination unit 17 illustrated in FIG. 2 and receives a control signal that controls the driving of the motor 430 from the controller, which is not illustrated. The driving unit 12 illustrated in FIG. 2 includes the control section 411 and the PWM control signal generator 412.

To the motor control unit 410, an encoder signal is input that is output from an encoder 432, which detects the rotation of the motor 430 and will be described later. The motor control unit 410 performs feedback control on the basis of the control signal received from the controller and the encoder signal input from the encoder 432, and produces a motor driving control signal that is transmitted to the pre-driver 420.

In the motor control unit 410, the control section 411 produces an instruction signal that instructs the rotation speed and the rotation direction of the motor 430 on the basis of the control signal transmitted from the controller, and supplies the instruction signal to the PWM control signal generator 412. The absolute value of the voltage value of the instruction signal represents the rotation speed while a symbol indicating a positive or negative polarity of the instruction signal represents the rotation direction, for example.

The PWM control signal generator 412 outputs the voltage value of the instruction signal supplied from the control section 411 as the PWM control signal. The driving unit 12 uses the PWM control signal as the driving output. The PWM control signal generator 412 supplies the signal indicating the symbol of the instruction signal to the setting section 414. The setting section 414 produces a clockwise/counterclockwise (CW/CCW) signal that sets the rotation direction of the motor 430 in accordance with the signal indicating the symbol. The setting section 414 produces the CW/CCW signal that sets a first rotation direction when the polarity of the symbol of the indication signal is positive. The setting section 414 produces the CW/CCW signal that sets a second rotation direction opposite to the first rotation direction when the polarity of the symbol of the indication signal is negative, for example.

The control section 411 produces a BRAKE signal that controls braking of the motor 430. The PWM control signal produced by the PWM control signal generator 412, the CW/CCW signal produced by the setting section 414, and the BRAKE signal produced by the control section 411 are supplied to the pre-driver 420 as the motor driving control signal that drives the motor 430.

When a motor driving mode included in the control signal received by the control section 411 indicates a position hold mode, the setting section 414 is controlled by the control section 411 such that the setting section 414 sets the rotation direction of the motor 430 and outputs the CW/CCW signal indicating the set rotation direction.

The pre-driver 420 includes a logic circuit 422. The PWM control signal output from the PWM control signal generator 412 of the motor control unit 410 is supplied to the logic circuit 422. The logic circuit 422 produces a PWM signal having a duty ratio according to the supplied PWM control signal. The PWM control signal is a command signal having a level corresponding to a desired duty ratio, for example. The logic circuit 422 produces triangle waves having a driving period of the motor 430 and compares the amplitude of the produced triangle waves with the command signal, thereby producing the PWM signal having the duty ratio commanded by the command signal.

The motor 430 is driven by a driver circuit that includes an H-bridge circuit composed of switching elements Q1 to Q4 using field-effect transistors (FETs), for example. FIG. 18 illustrates a two-phase H-bridge circuit for ease of explanation as an example of the driver circuit. When three-phase H-bridge circuit is used as the driver circuit, one more set of a pair of upper and lower switching elements is added to the motor 430.

U-phase, a V-phase, and a W phase motor driving signals output from the logic circuit 422 are supplied to the gates of the respective corresponding switching elements Q1 to Q4 and a motor driving voltage Vdd is supplied to the driver circuit. The respective switching elements Q1 to Q4 are controlled by certain timing by the respective corresponding phase driving signals, thereby driving the motor 430 to rotate.

The logic circuit 422 can control the motor 430 such that the rotation direction of the motor 430 is switched between the first and the second rotation directions by changing the order of the three phase motor driving signals and Hall signals in accordance with the CW/CCW signal. The logic circuit 422 can stop the motor 430 by causing the terminals of the motor 430 to be short-circuited in accordance with the BRAKE signal to brake the motor 430, for example.

The Hall element 431, which is included in the motor 430, outputs analog signals corresponding to intensities of magnetic fields of the motor 430. The Hall signals output from the Hall element 431 are subjected to certain signal processing such as amplification by a signal processing circuit (not illustrated) and then supplied to the logic circuit 422.

The encoder 432 is disposed on the shaft of the motor 430, for example. The encoder 432 outputs a phase A encoder signal and a phase B encoder signal according to the rotation of the motor 430. The encoder signals are supplied to the motor control unit 410. In the motor control unit 410, the control section 411 can monitor the rotation amount, the rotation speed, and the rotation direction of the motor 430 on the basis of the received encoder signals, for example.

The encoder 432 is not limited to being disposed on the shaft of the motor 430. The encoder 432 may be provided to a portion that moves in synchronization with an object that is driven and controlled by the motor 430, for example. The rotation speed of the motor 430 may be detected using the Hall signals output from the Hall element 431 instead of the encoder 432. This case allows the encoder 432 serving as a sensor for detecting speed to be omitted, thereby making it possible to reduce cost.

A resistor R is a shunt resistor that is used for the motor control unit 410 to monitor a total current flowing in the motor 430. The current monitoring output by the resistor R is supplied to the motor control unit 410.

In the structure described above, the motor control unit 410 produces the PWM control signal on the basis of the output of the encoder 432 included in the motor 430 such that the rotation speed of the motor 430 is constant. The motor control unit 410 performs the processing described with reference to the flowchart of FIG. 15 on the basis of the PWM control signal and determines whether the separation state of the document MS is in any of the normal separation, the overlapped feeding state, the non-feeding state, the overlapped feeding tendency state, and the non-feeding tendency state. The motor control unit 410 may directly control the driving of the motor 430 on the basis of the determination result or may transmit the determination result to the controller, which is not illustrated.

In this way, the overlapped feeding and the non-feeding can be detected before the document MS reaches the registration sensor 65, thereby making it possible to prevent the occurrence of a reading error due to the overlapped feeding and the non-feeding.

The motor control unit 410 may determine the separation state of the document MS on the basis of the current monitoring output by the resistor R instead of the PWM control signal. The total current flowing in the motor 430 is converted into a voltage across the resistor R. The motor control unit 410 regards the voltage across the resistor R as the motor driving output, for example, and performs the processing of the flowchart of FIG. 15.

When the motor 430 is controlled by current feedback control of the digital feedback control method, the driving torque can be readily estimated from a value of a current that drives the motor 430. For example, the motor control unit 410 can use known digital proportional integral derivative (PID) feedback control as the feedback control of the motor 430. In this case, the motor control unit 410 measures and calculates feature amounts indicating features of the respective output values and changes in feature amounts, and estimates the mechanical load torque in relation to the rotation of the motor using a target speed, a present speed, a speed variance, a target position, a present position, a positional variance, respective PID outputs, and the motor driving output, which are the input and output values in the feedback control. The motor control unit 410 determines the sheet separation state using a single feature amount or the combination of the multiple feature amounts, and controls the motor 430 on the basis of the determination result. The motor control unit 410 may store the determination result in a storage, which is not illustrated.

In the second embodiment, the overlapped feeding and the non-feeding of the document MS in the image reading unit 50 is detected. The unit to which the first embodiment is applied is not limited to this example. The first embodiment may also be applied to another unit having a structure that separates one sheet from the stacked sheets and conveys the separated sheet, in the second embodiment. In the example illustrated in FIG. 16, the first embodiment can be applied to the transfer sheet separation unit including the transfer sheet sending rollers 43 each feeding the transfer sheets from the corresponding transfer sheet feeding cassette 42 and the transfer sheet separation rollers 45 each separating the sheet from the fed transfer sheets and supplying the separated transfer sheet to the transfer sheet feeding path 44, for example.

Third Embodiment

The following describes a third embodiment of the present invention. In the third embodiment, the control of the conveyance system in the first embodiment is performed using the digital feedback control. In the third embodiment, the structures of the MFP 500 illustrated in FIG. 16 and the ADF 51 illustrated in FIG. 17 are used.

Figure 19:
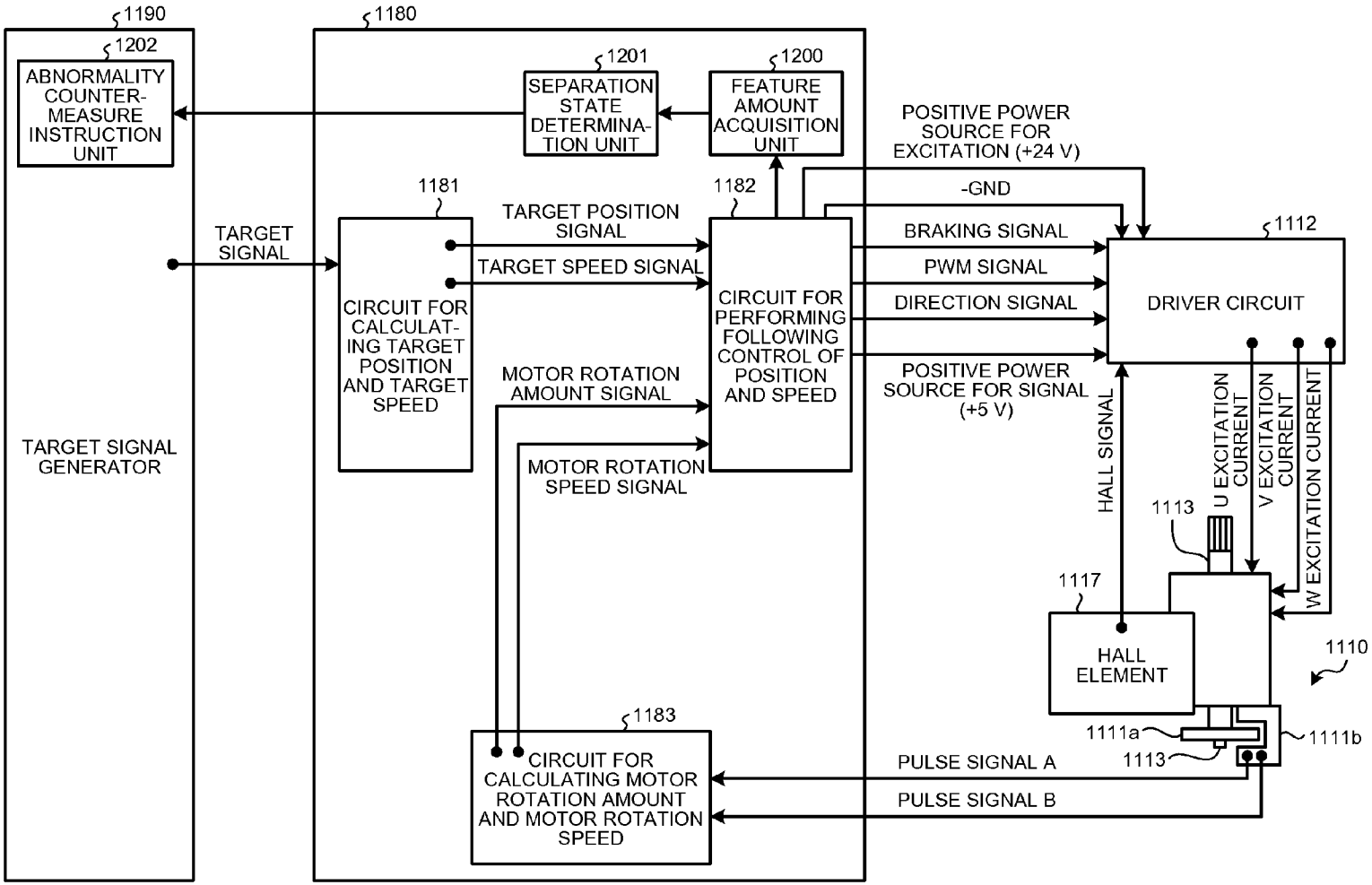
FIG. 19 is a block diagram illustrating an exemplary structure of a motor control system according to a third embodiment.

FIG. 19 illustrates an exemplary structure of a control system that controls the motor driving both of the driving roller 82 and the pullout roller pair 86 according to the third embodiment. A motor control circuit 1180 controls a motor 1110, which is a DC brushless motor. The motor control circuit 1180 includes a circuit 1181 for calculating target position and target speed, a circuit 1182 for performing following control of position and speed, and a circuit 1183 for calculating motor rotation amount and motor rotation speed.

A target signal generator 1190 in FIG. 19 produces a target signal in relation to a target rotation amount, a target rotation speed, and a target rotation stop position of the motor 1110. The control unit that controls the whole of the MFP 500 to which this control system is applied may function as the target signal generator 1190. The motor control circuit 1180 can be structured using a one-chip microprocessor or an application specific integrated circuit (ASIC) for control.

The target signal sent from the target signal generator 1190 to the motor control circuit 1180 is input to the circuit 1181 of the motor control circuit 1180. The circuit 1181 calculates the target motor stop position at which a motor shaft 1113 serving as the rotation shaft of the motor 1110 is stopped with a target rotation posture on the basis of the input target signal, and outputs the result as a target position signal. The circuit 1181 calculates the target motor rotation speed with which the motor shaft 1113 rotates on the basis of the target signal, and outputs the result as a target speed signal.

The motor 1110 is provided with a motor encoder including a code wheel 1111*a* having slits on its circumference and an optical sensor 1111*b* detecting light passing through the slit of the code wheel 1111*a*. The code wheel 1111*a*, the optical sensor 1111*b*, and the motor 1110 have the common rotation shaft. The optical sensor 111*b* uses a two-channel optical sensor having a first light receiving section and a second light receiving section both of which serve as a light receiving section that receives light after passing through the slit. The optical sensor 1111*b* is structured such that the second light receiving section faces a no-slit portion of the wheel when the slit of the code wheel 1111*a* faces the first light receiving section. The no-slit portion is next to the slit and is provided with no slit.

The motor control circuit 1180 highly accurately grasps the timing when the slit of the code wheel 1111*a* faces each light receiving section without no shift from the light receiving section on the basis of a change in ratio of a light receiving amount of the first light receiving section to a light receiving amount of the second light receiving section of the optical sensor 1111*b*. The first light receiving section outputs a voltage corresponding to the light receiving amount as a pulse signal A. The second light receiving section outputs a voltage corresponding to the light receiving amount as a pulse signal B.

The pulse signal A and the pulse signal B output from the optical sensor 1111*b* are input to the circuit 1183 of the motor control circuit 1180. The circuit 1183 calculates the motor rotation amount and the motor rotation speed on the basis of the computing result of the number of pulses and a pulse frequency for each of the pulse signals A and B. The circuit 1183 outputs a motor rotation amount signal indicating the calculated motor rotation amount and a motor rotation speed signal indicating the calculated motor rotation speed.

The circuit 1182 consistently supplies GND (a negative power source) to the driver circuit 1112. The circuit 1182 supplies a positive power source (+24 V) for excitation and a positive power source (+5 V) for signal to the driver circuit 1112 when needed. Furthermore, the circuit 1182 individually supplies the braking signal, the PWN signal, and a direction signal (CW or CCW) to the driver circuit 1112 when needed. The circuit 1182 outputs, as the direction signal, either a forward rotation signal to order the motor to rotate forward or a reverse rotation signal to order the motor to rotate reverse. The PWM signal instructs a value of an excitation current output to each of the coils of the motor 1110 from the driver circuit 1112.

The motor 1110 has a Hall element 1117. The Hall element 1117 outputs Hall signals indicating a rotation angle posture of the motor shaft 1113 of the motor 1110 for each 120 degrees from zero degrees serving as a reference angle to the driver circuit 1112, for example.

The driver circuit 1112 includes an output adjusting section and a coil switching section, which are not illustrated. The output adjusting section adjusts the output of an excitation current flowing in each of the coils of the motor 1110 on the basis of the PWM signal output from the position-speed following control circuit 1182 of the motor control circuit 1180. The coil switching section switches three phase coils of the motor 1110 to set the coil to which the excitation current is applied.

More specifically, the output adjusting section adjusts the value of the excitation current flowing in the coil per unit time via the coil switching section by turning on and off the output of a voltage of +24 V to the coil switching section on the basis of the PWM signal. The coil switching section includes a pre-driver and a plurality of field-effect transistors (FETs). The multiple FETs include at least a first FET that turns on and off the output of a U excitation current to excite a first phase coil, a second FET that turns on and off the output of a V excitation current to excite a second phase coil, and a third FET that turns on and off the output of a W excitation current to excite a third phase coil. The pre-driver outputs a gate voltage that controls the switching by the FET for each of the FETs.

The pre-driver switches the excitation current output to the motor 1110 among the U excitation current, the V excitation current, and the W excitation current by individually controlling the turning on and off of the gate voltage of each of the three FETs on the basis of the Hall signals from the Hall element 1117. The switching causes a rotation force due to the switching of magnetic field to be applied to the motor shaft 1113 of the motor 1110.

The circuit 1182 calculates an amount of shift of the motor rotation speed signal sent by the circuit 1183 from the target speed signal, and adjusts the PWM signal on the basis of the calculated shift amount, thereby adjusting the excitation current applied to the motor 1110. As a result, the circuit 1182 performs speed adjustment processing that controls the rotation speed of the motor 1110 to the target rotation speed. The speed adjustment processing can freely adjust the rotation speed of the motor shaft 1113 of the motor 1110.

The circuit 1182 receives the motor rotation amount signal from the circuit 1183 and the target position signal from the 1181. The circuit 1182 acquires braking timing of the motor 1110 on the basis of the motor rotation amount signal and the target position signal, stops the output of the PWM signal to the driver circuit 1112 at the braking timing, and outputs the brake signal, thereby stopping the motor 1110 with the target rotation angle posture.

While the motor 1110 is stopped, the circuit 1182 performs hold processing. In the hold processing, the circuit 1182 monitors whether the motor shaft 1113 rotates forward or reverse on the basis of the motor rotation amount signal sent from the circuit 1183. When detecting the forward rotation, the circuit 1182 drives the motor 1110 to rotate in reverse by an amount corresponding to the forward rotation amount. When detecting the reverse rotation, the circuit 1182 drives the motor 1110 to rotate forward by an amount corresponding to the reverse rotation amount. As a result, an object driven by the rotation driving force of the motor 1110 is held with the target rotation posture. The structure thus described holds the motor 1110 with a desired rotation angle posture by the hold processing without providing helical gears, thereby making it possible to downsize the device and simplify the device structure.

In FIG. 19, a feature amount acquisition unit 1200 receives the PWM signal and the motor rotation speed signal from the circuit 1182. On the basis of the PWM signal and the motor rotation speed signal, the feature amount acquisition unit 1200 acquires a feature amount used for determining the presence or absence of the overlapped feeding state, the respective patterns of the overlapped feeding state, the overlapped feeding tendency state, and the non-feeding tendency state. The feature amount acquisition unit 1200 acquires a change in driving output to the motor 1110 as the feature amount on the basis of the PWM signal and the motor rotation speed signal, for example.

More specifically, the feature amount acquisition unit 1200 obtains a voltage value by integrating the PWM signal supplied from the circuit 1182 and estimates the driving torque T of the motor 1110 in the voltage driving method on the basis of the obtained voltage value. Let the voltage value obtained by integrating the PWM signal be a motor output voltage (motor driving output) $V_M$ and a counter-electromotive voltage of the motor 1110 be $V_D$, a driving torque voltage $V_T$ is defined by expression (8).

$$V_T=V_M-V_D \tag{8}$$

The driving torque T is calculated by expression (9) using a torque constant Kt and a motor winding resistance $R_M$, which are values unique to the motor 1110.

$$T=(V_T/R_M)\times Kt \tag{9}$$

The counter-electromotive voltage $V_D$ is calculated by expression (10) using a counter-electromotive voltage coefficient Ke, which is a value unique to the motor 1110, and a rotation number N of the motor 1110. The motor rotation number N is the number of rotations per unit time and corresponds to the rotation speed of the motor. The motor rotation number N may be acquired as the present rotation number of the motor 1110 on the basis of the motor rotation speed signal, or as the target speed signal.

$$V_D=N\times Ke \tag{10}$$

The driving torque T is obtained by expression (11) from expressions (8) to (10).

$$T=Kt\times[V_M-(N\times Ke)]/R_M \tag{11}$$

In expression (11), the values of Ke, Kt, and $R_M$ are unique to the motor 1110. The driving torque T, thus, can be estimated when the motor output voltage $V_M$ is known in the case where the motor rotation number N is a controlled constant. When the motor rotation number N is a controlled constant, a change in the driving torque T corresponds to a change in the mechanical load torque Tr.

The feature amount acquisition unit 1200 acquires the feature amount indicating a change in the mechanical load torque Tr of the motor 1110 on the basis of the motor output voltage $V_M$ obtained from the PWM signal, and supplies the feature amount to a separation state determination unit 1201. The separation state determination unit 1201 performs the determination processing in accordance with the flowchart of FIG. 15 on the basis of the supplied feature amount and determines the sheet separation state. The determination result is supplied to the target signal generator 1190 and input to an abnormality countermeasure instruction unit 1202.

The abnormality countermeasure instruction unit 1202 instructs a countermeasure when an abnormality occurs in the sheet separation to the target signal generator 1190 in accordance with the determination result supplied from the separation state determination unit 1201. For example, at any of step S104, step S105, and step S110 in the flowchart of FIG. 15 based on the determination result of the sheet separation state being the overlapped feeding state, the abnormality countermeasure instruction unit 1202 instructs the target signal generator 1190 to produce the target signal to stop the conveyance operation in accordance of the processing at step S106.

Likewise, when it is determined that the sheet separation state is the non-feeding state at step S114 in the flowchart of FIG. 15, the abnormality countermeasure instruction unit 1202 instructs the target signal generator 1190 to produce the target signal to stop the conveyance operation.

When it is determined that the sheet separation state is the overlapped feeding tendency state at step S117 or when it is determined that the sheet separation state is the non-feeding tendency state at step S118 in the flowchart of FIG. 15, the abnormality countermeasure instruction unit 1202 can instruct the target signal generator 1190 to produce the target signal to recover the normal state by eliminating the abnormal state.

For example, when it is determined that the distance between sheets is shorter than the specified distance in the overlapped feeding tendency state, the abnormality countermeasure instruction unit 1202 instructs the target signal generator 1190 to produce the target signal to reduce the rotation speed of the motor 1110 for adjusting the distance between sheets to be longer. For another example, when it is determined that the distance between sheets is longer than the specified distance in the non-feeding tendency state, the abnormality countermeasure instruction unit 1202 instructs the target signal generator 1190 to produce the target signal to increase the rotation speed of the motor 1110 for compensating the amount of a delay in the sheet conveyance.

In this way, the overlapped feeding tendency state and the non-feeding tendency state are detected and recovery processing is performed, thereby preventing the reduction in productivity in copying operation and scanner operation of the MFP 500. The detection of the overlapped feeding tendency state and the implementation of the recovery processing can prevent jamming or breakage of the sheet from occurring, thereby making it possible to prevent the occurrence of a failure in the system.

The action taken by the abnormality countermeasure instruction unit 1202 is not limited to that in the examples described above. The abnormality countermeasure instruction unit 1202 may store the determination result in a storage (not illustrated) in an accumulative manner, when it is determined that the sheet separation state is the overlapped feeding tendency state or the non-feeding tendency state. The accumulated determination results on the overlapped feeding tendency state and the non-feeding tendency state in the storage are usable for maintenance, for example.

Figure 20:
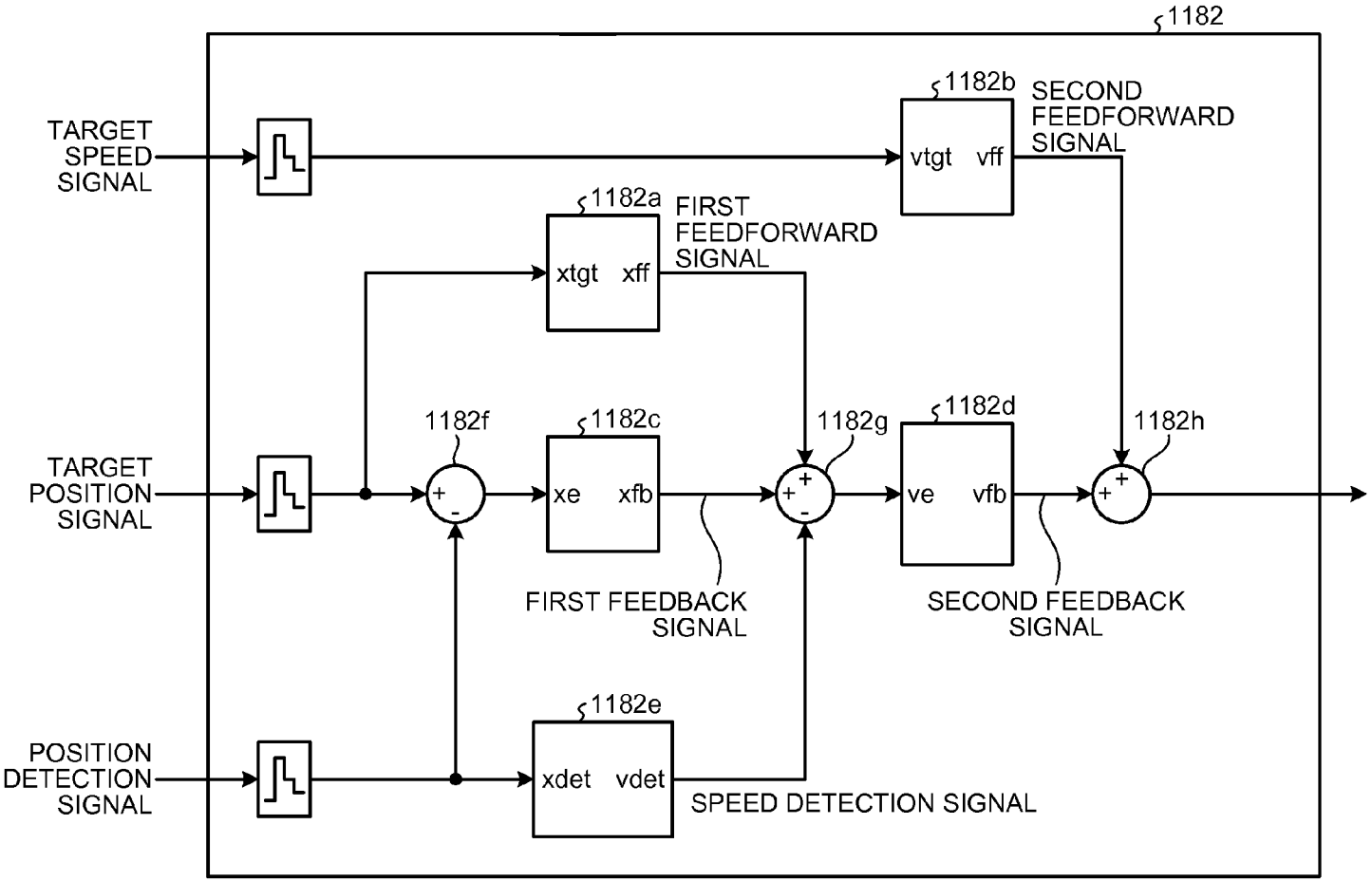
FIG. 20 is a block diagram illustrating an exemplary structure of a position-speed following control circuit included in a motor control circuit according to the third embodiment.

FIG. 20 illustrates an exemplary structure of the circuit 1182 included in the motor control circuit 1180 illustrated in FIG. 19. The circuit 1182 includes a position feedforward control circuit 1182*a*, a speed feedforward control circuit 1182*b*, a position feedback control circuit 1182*c*, a speed feedback control circuit 1182*d*, a speed detection circuit 1182*e*, a first addition-subtraction circuit 1182*f*, a second addition-subtraction circuit 1182*g*, and an addition circuit 1182*h*.

The motor 1110, which is the DC brushless motor, is generally inferior to the stepping motor in position following capability and speed following capability at starting time and stopping time. In the third embodiment, the motor control circuit 1180 preliminarily acquires the operation characteristics of the motor 1110 at a starting time and a stopping time. The motor control circuit 1180 makes a position following profile and a speed following profile for enhancing the position following capability and the speed following capability at the starting time and the stopping time on the basis of the acquired operation characteristics, and stores the position following profile and the speed following profile in the circuit 1181. The target position-speed calculation circuit 1181 produces the target position signal and the target speed signal on the basis of the stored position following profile and speed following profile.

The first addition-subtraction circuit 1182*f* receives the target position signal received by the circuit 1182 as a value to be added. The first addition-subtraction circuit 1182*f* receives the position detection signal produced on the basis of the motor rotation amount detection result by the motor encoder as a value to be subtracted. The first addition-subtraction circuit 1182*f* outputs zero when the actual motor rotation position (a position detection signal) and the target rotation position (the target position signal) are the same. When the actual motor rotation position is ahead of the target rotation position, the first addition-subtraction circuit 1182*f* outputs a minus value. When the actual motor rotation position is behind the target rotation position, the first addition-subtraction circuit 1182*f* outputs a plus value. The output of the first addition-subtraction circuit 1182*f* is input to the position feedback control circuit 1182*c*. The position feedback control circuit 1182*c* converts the received output of the first addition-subtraction circuit 1182*f* from position to speed and outputs the result as a first feedback signal.

The target position signal received by the circuit 1182 is also input to the position feedforward control circuit 1182*a*. The position feedforward control circuit 1182*a* converts the target position into speed and outputs the result as a first feedforward signal. The first feedback signal output from the position feedback control circuit 1182*c* and the first feedforward signal output from the position feedforward control circuit 1182*a* are input to the second addition-subtraction circuit 1182*g* as the values to be added.

The position detection signal received by the circuit 1182 is also input to the speed detection circuit 1182*e*. The speed detection circuit 1182*e* calculates the rotation speed of the motor on the basis of a temporal change in input position detection signal and outputs the result as a speed detection signal. The speed detection signal is input to the second addition-subtraction circuit 1182*g* as a value to be subtracted. The second addition-subtraction circuit 1182*g* adds the respective signals input as the values to be added and subtracts the signal input as the value to be subtracted from the addition result, and outputs the result as a signal indicating a speed.

The output of the second addition-subtraction circuit 1182*g* is input to the speed feedback control circuit 1182*d*. The speed feedback control circuit 1182*d* converts the signal indicating the speed into a voltage value that achieves an increase or a decrease in speed, and outputs the voltage value to the addition circuit 1182*h* as a second feedback signal. When the symbol of the signal is plus, the speed is increased while when the symbol of the signal is minus, the speed is decreased.

The target speed signal received by the circuit 1182 is also input to the speed feedforward control circuit 1182*b*. The speed feedforward control circuit 1182*b* converts the input target speed signal into a voltage value that achieves the target speed indicated by the target speed signal, and outputs the voltage value to the addition circuit 1182*h* as a second feedforward signal. The addition result of the voltages by the addition circuit 1182*h* is output to the driver circuit 1112 as the PWM signal.

In the structure described above, a feedback control value based on a difference between the speed detection result and the target speed, and a feedback control value based on a difference between the position detection result and the target position are added to a feedforward control value based on the position following profile and the speed following profile. As a result, the control system according to the third embodiment can cause the motor 1110, which is a DC brushless motor, to demonstrate the position following capability and the speed following capability comparable to those of the stepping motor.

The embodiments of the invention has an advantageous effect of being capable of detecting the conveyance state of the separated and conveyed sheet using a simpler structure.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A separation conveyance device, comprising:

a separating device including, a first roller configured to feed a conveyance object, and a load unit configured to apply a load to the conveyance object fed by the first roller, and to separate the conveyance object from a plurality of conveyance objects using the load;

a second roller configured to convey the conveyance object fed from the first roller;

a motor configured to generate power;

a transmission system configured to, rotate the first roller at a first linear speed and the second roller at a second linear speed higher than the first linear speed based on the power of the motor, and cut off the power of the motor from the first roller when the second roller conveys the conveyance object; and a controller configured to determine a separation state of the conveyance object by the separating device based on load torque applied from the transmission system to a motor shaft of the motor in a direction opposite to a rotation direction of the motor shaft.

2. The separation conveyance device according to claim 1, wherein the controller is configured to determine the separation state based on a peak of the load torque detected in a time period during which the load torque exceeds a threshold.

3. The separation conveyance device according to claim 1, wherein the controller is configured to, measure a time period during which the load torque is smaller than a threshold, compare the measured time period with a reference time period, and determine the separation state based on the comparison result.

4. The separation conveyance device according to claim 3, wherein the controller is configured to determine that the separation state of the conveyance object is in a tendency of overlapped feeding when the measured time period is shorter than the reference time period.

5. The separation conveyance device according to claim 4, wherein the transmission system is configured to drive the motor such that a rotation speed of the motor is lower than the rotation speed of the motor in a case where the conveyance object is conveyed normally, if the controller determines that the separation state of the conveyance object is in the tendency of overlapped feeding.

6. The separation conveyance device according to claim 3, wherein the controller is configured to determine that the separation state of the conveyance object is in a tendency of non-feeding when the measured time period is longer than the reference time period.

7. The separation conveyance device according to claim 6, wherein the transmission system is configured to drive the motor such that a rotation speed of the motor is higher than the rotation speed of the motor in a case where the conveyance object is conveyed normally, if controller determines that the separation state of the conveyance object is in the tendency of non-feeding.

8. An image forming apparatus, comprising:

the separation conveyance device according to claim 1; and an image reading device configured to read an image of the conveyance object separated by the separation conveyance device and conveyed to the image reading device.

9. The separation conveyance device according to claim 1, wherein the controller is configured to control a rotation speed of the motor via feedback-control.

10. A method for controlling a separation conveyance device, the conveyance device including a separation device having a first roller and a load unit, a second roller, a motor configured to generate power, a transmission system and a controller, the method comprising:

feeding, via the first roller, a conveyance object; and applying, via the load unit, a load to the conveyance object fed by the first roller to separate the conveyance object from a plurality of conveyance objects using the load;

conveying, via the second roller, the conveyance object fed from the first roller;

rotating, via the transmission system, the first roller at a first linear speed and the second roller at a second linear speed higher than the first linear speed;

cutting off, via the transmission system, the power of the motor from the first roller when the second roller conveys the conveyance object; and determining, via the controller, a separation state of the conveyance object by the separating device based on load torque applied from the transmission system to a motor shaft of the motor in a direction opposite to a rotation direction of the motor shaft.

11. The method for controlling a separation conveyance device according to claim 10, further comprising:

controlling, via the controler, a rotation speed of the motor via feedback-control.

12. A non-transitory computer-readable recording medium that contains a control program that causes a controller included in a separation conveyance device having a separation device including a first roller and a load unit, a second roller, a motor configured to generate power, and a transmission system, to execute:

feeding, via the first roller, a conveyance object, and applying, via the load unit, a load to the conveyance object fed by the first roller to separate the conveyance object from a plurality of conveyance objects using the load, conveying, via the second roller, the conveyance object fed from the first roller, rotating, via the transmission system, the first roller at a first linear speed and the second roller at a second linear speed higher than the first linear speed, cutting off, via the transmission system, the power of the motor from the first roller when the second roller conveys the conveyance object, and determining, via the controller, a separation state of the conveyance object by the separating device based on load torque applied from the transmission system to a motor shaft of the motor in a direction opposite to a rotation direction of the motor shaft.

13. The non-transitory computer-readable recording medium according to claim 12, wherein the control program, when executed, further causes the controller to control a rotation speed of the motor via feedback-control.

* * * * *